US009541848B2

(12) United States Patent
Konishi et al.

(10) Patent No.: US 9,541,848 B2
(45) Date of Patent: Jan. 10, 2017

(54) ELECTROPHOTOGRAPHIC PHOTORECEPTOR

(71) Applicant: Konica Minolta, Inc., Tokyo (JP)

(72) Inventors: Mari Konishi, Mitaka (JP); Toshiyuki Fujita, Hachioji (JP); Daisuke Kodama, Hino (JP); Takeshi Nakamura, Hachioji (JP); Toyoko Shibata, Zama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/727,056

(22) Filed: Jun. 1, 2015

(65) Prior Publication Data

US 2015/0355560 A1 Dec. 10, 2015

(30) Foreign Application Priority Data

Jun. 6, 2014 (JP) ..... 2014-117457

(51) Int. Cl.

| | |
|---|---|
| ***G03G 15/04*** | (2006.01) |
| ***G03G 5/047*** | (2006.01) |
| ***G03G 5/06*** | (2006.01) |
| ***G03G 5/147*** | (2006.01) |

(52) U.S. Cl.

CPC ..... *G03G 5/047* (2013.01); *G03G 5/0614* (2013.01); *G03G 5/0668* (2013.01); *G03G 5/14704* (2013.01); *G03G 5/14791* (2013.01)

(58) Field of Classification Search

CPC G03G 5/047; G03G 5/14704; G03G 5/14791; G03G 5/0668; G03G 5/0614

USPC ..... 430/66, 58.65

See application file for complete search history.

(56) References Cited

U.S. PATENT DOCUMENTS

2004/0229141 A1* 11/2004 Goodbrand ..... G03G 5/0507 430/58.05

2010/0129115 A1* 5/2010 Ishida ..... G03G 5/14704 399/159

FOREIGN PATENT DOCUMENTS

| | | |
|---|---|---|
| JP | 2010130471 A | 6/2010 |
| JP | 2010169725 A | 8/2010 |
| JP | 2010180079 A | 8/2010 |
| JP | 2010262102 A | 11/2010 |

OTHER PUBLICATIONS

Office Action dated Jul. 19, 2016 from the corresponding Japanese Application; Patent Application No. 2014-117457; English translation of Office Action; Total of 8 pages.

* cited by examiner

*Primary Examiner* — Thorl Chea

(74) *Attorney, Agent, or Firm* — Lucas & Mercanti, LLP

(57) ABSTRACT

The electrophotographic photoreceptor of the present invention at least includes a charge-generating layer, a charge-transporting layer, and a surface protective layer sequentially deposited on an electroconductive support, wherein the charge-transporting layer contains a charge-transporting material having an ionization potential ($IP_A$); the surface protective layer contains a binder resin and a metal oxide microparticle having an ionization potential ($IP_B$); and the ionization potential ($IP_A$) and the ionization potential ($IP_B$) satisfy the relationship represented by Expression (A): $-0.4\ eV \leq (IP_A - IP_B) \leq 0.4\ eV$.

8 Claims, 2 Drawing Sheets

ELECTROPHOTOGRAPHIC PHOTORECEPTOR

BACKGROUND OF THE INVENTION

Field of the Invention

The present invention relates to electrophotographic photoreceptors. More specifically, the invention relates to an electrophotographic photoreceptor having high durability and providing high-quality images.

Description of Related Art

Recent demands on electrophotographic imaging apparatuses are a high printing rate, a reduction in size, and ease of maintenance. These demands have placed new demands, for example, a reduction in diameter (a reduction in size) and an enhancement of durability on photoreceptor drums of apparatuses for forming electrophotographic images. The photosensitive layer of an organic photoreceptor (hereinafter, also referred to as "photoreceptor"), which has been generally used as an electrophotographic photoreceptor is composed of a charge-transporting material, a binder resin, and other components and can be readily worn by mechanical load.

The photoreceptor is worn by friction with a cleaning blade and also loses its original electrical characteristics, such as chargeability and optical sensitivity, by the repeated charging and exposure in the image forming processes. These deteriorations cause defects in images, such as a reduction in image density, smudgy background noise, or image blurring in high-temperature and high-humidity environments. Local scratches occurring by wear of the surface of a photoreceptor cause defects in images, such as stripe noise due to insufficient cleaning, leading to a reduction in service life of the photoreceptor. Throughout the specification, the term "image blurring" refers to a phenomenon that electric discharge products, such as ozone and nitrogen oxide, hydrophilize the surface of a photoreceptor to cause disorder in an electrostatic latent image in high-temperature and high-humidity environments and thereby to form unclear toner images.

In order to enhance the durability of a photoreceptor, the photoreceptor should have improved wear resistance. Techniques of providing a surface protective layer onto the surface of the photosensitive layer have been investigated. For example, a proposed technique of providing high wear resistance to a surface protective layer is addition of a curable binder resin and inorganic microparticles to the surface protective layer.

Although the surface protective layer enhances the film strength of the photoreceptor, it causes reductions in electrical characteristics, such as an increase in residual potential, or image memory (a difference in image density, i.e., the history of density in images occurring depending on the photoreceptor cycle). In order to prevent a reduction in electrical characteristics and defects in images by a surface protective layer, a proposed technique involves addition of a charge-transporting material to the surface protective layer for providing charge transportability.

In surface protective layers that have been proposed, however, the compatibility between the charge-transporting material of a low molecular weight and the curable binder resin is low, which precludes charge transfer by the surface protective layer, increases the residual potential, and forms defects in images, such as a reduction in image density. In addition, the plasticizing effect of the low-molecular-weight charge-transporting material causes a reduction in wear resistance of the surface protective layer.

For solving these problems, proposed techniques involve addition of inorganic microparticles to a surface protective layer where the surfaces of the microparticles are modified with a compound having hole transportable groups (see, for example, Japanese Patent Laid-Open Nos. 2010-130471 and 2010-180079). In these techniques, inorganic microparticles surface-modified with an alkoxysilane having a hole transportable group are uniformly dispersed in a surface protective layer. The filler effect by the inorganic microparticles and the curable binder resin can enhance the wear resistance, and prevent image blurring in high-temperature and high-humidity environments due to electric discharge products, such as ozone and nitrogen oxide.

The inorganic microparticles surface-modified with a surface modifier (also referred to as "surface treating agent") having a hole transportable group can facilitate the charge transfer (transfer of holes) in the surface protective layer. The addition of the particles therefore inhibits trapping of the charge in the surface protective layer and has advantages of inhibiting a reduction in sensitivity characteristics and reducing the occurrence of image memory.

In recent years, the use of electrophotographic imaging apparatuses in the quick printing field has been rapidly expanded, and higher durability and higher image quality are demanded in photoreceptors. These demands, however, cannot be sufficiently satisfied by the known techniques described above, and further reductions in image memory and image blurring are needed.

An object of the present invention, which has been made in view of the above-mentioned problems and circumstances, is to provide an electrophotographic photoreceptor that has high wear resistance, does not cause image blurring in high-temperature and high-humidity environments or image memory, and can form high-quality electrophotographic images.

SUMMARY OF THE INVENTION

The present inventors have found, in the process of investigating the causes of the above-mentioned problems for achieving the above-mentioned object, that the problems can be solved by reducing the difference between the ionization potential ($IP_A$) of a charge-transporting material contained in the charge-transporting layer of an electrophotographic photoreceptor and the ionization potential ($IP_B$) of a metal oxide microparticle contained in the surface protective layer. The object of the present invention can be achieved by the following aspects:

That is, in accordance with the first aspect of the present invention, an electrophotographic photoreceptor comprising:

a charge-generating layer;

a charge-transporting layer, and a surface protective layer sequentially deposited on an electroconductive support, wherein the charge-transporting layer contains a charge-transporting material having an ionization potential ($IP_A$);

the surface protective layer contains a binder resin and a metal oxide microparticle having an ionization potential ($IP_B$); and the ionization potential ($IP_A$) and the ionization potential ($IP_B$) satisfy the relationship represented by Expression (A):

$$-0.4\ \text{eV} \leq (IP_A - IP_B) \leq 0.4\ \text{eV}.$$

The metal oxide microparticle is preferably surface-modified with a hole-transporting compound having a structure represented by Formula (1):

[Chem. 1]

$$A\text{-}(R_1\text{-}Q_1)_k \qquad \text{Formula(1)}$$

where A represents a hole transportable group; $Q_1$ represents an acidic group; $R_1$ represents a substituted or unsubstituted alkylene, alkenylene, alkynylene, or arylene group; and k represents a positive integer of 1 or more, provided that when k represents an integer of 2 or more, $R_1$'s may be the same or different, and $Q_1$'s may be the same or different.

The hole-transporting compound having a structure represented by Formula (1) is preferably a compound having a structure represented by Formula (2):

[Chem. 2]

Formula (2)

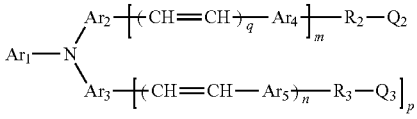

where $Ar_1$ represents a substituted or unsubstituted aryl group; $Ar_2$, $Ar_3$, $Ar_4$, and $Ar_5$ each independently represent a substituted or unsubstituted arylene group; $R_2$ and $R_3$ each independently represent a substituted or unsubstituted alkylene, alkenylene, alkynylene, or arylene group; $Q_2$ and $Q_3$ each independently represent an acidic group; m, n, p, and q each independently represent 0 or 1, provided that when p represents 0, $Ar_3$ represents a substituted or unsubstituted aryl group.

The acidic group represented by $Q_2$ or $Q_3$ in Formula (2) is preferably a carboxy, phosphonate, phosphinate, or sulfonate group.

The binder resin contained in the surface protective layer is preferably prepared by polymerization of a crosslinkable polymerizable compound.

The crosslinkable polymerizable compound preferably has an acryloyl group or a methacryloyl group.

The metal oxide microparticle is preferably surface-modified with a hole-transporting compound represented by Formula (1) and a coupling agent having a polymerizable reactive group.

The coupling agent having a polymerizable reactive group is preferably a silane coupling agent having a polymerizable reactive group.

The metal oxide microparticle is preferably a $SnO_2$ microparticle, a $TiO_2$ microparticle, an $Al_2O_3$ microparticle, or a $CuAlO_2$ microparticle.

A plausible mechanism of the operation and advantageous effect of the present invention is as follows, although it is unclear:

The photoreceptor of the present invention at least includes a charge-generating layer, a charge-transporting layer, and a surface protective layer sequentially deposited on an electroconductive support. The photoreceptor is charged with electricity (negative charge), is then subjected to image exposure, and generates charge (electrons and holes) in the charge-generating layer. The holes generated in the charge-generating layer are injected into the charge-transporting layer. The holes transferred to the charge-transporting layer are injected into the surface protective layer. On this occasion, if the difference between the ionization potential ($IP_A$) of the charge-transporting material in the charge-transporting layer and the ionization potential ($IP_B$) of the metal oxide microparticle in the surface protective layer is within the range of Expression (A), the charge (holes) is efficiently injected from the charge-transporting layer into the surface protective layer. Accordingly, the charge (holes) is not trapped at the interface between the charge-transporting layer and the surface protective layer and is efficiently injected into the surface protective layer. The injected charge is movable in the surface protective layer. Image memory thereby does not occur. In addition, the surface protective layer containing metal oxide microparticles can have high hardness due to their filler effect and has enhanced wear resistance. Such a mechanism allows an increase in urging force by a cleaning blade, can effectively remove electric discharge products on the surface of the photoreceptor, such as ozone and nitrogen oxide, and thus can prevent image blurring.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
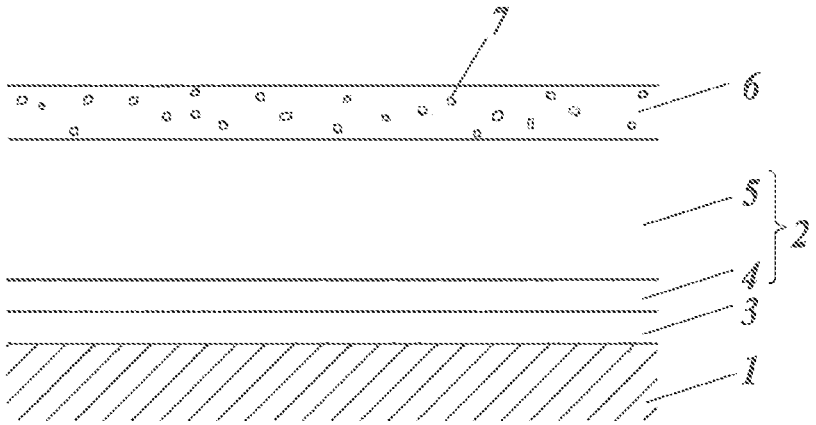
FIG. 1 is a schematic diagram illustrating an example layer configuration of a photoreceptor.

The electrophotographic photoreceptor of the present invention at least includes a charge-generating layer, a charge-transporting layer, and a surface protective layer sequentially deposited on an electroconductive support. The charge-transporting layer contains a charge-transporting material. The surface protective layer contains a binder resin and a metal oxide microparticle. The ionization potential ($IP_A$) of the charge-transporting material contained in the charge-transporting layer and the ionization potential ($IP_B$) of the metal oxide microparticle contained in the surface protective layer satisfy the relationship represented by Expression (A):

$$-0.4\ \text{eV} \leq (IP_A - IP_B) \leq 0.4\ \text{eV}.$$

These are technical features common to claims 1 to 9.

In an embodiment of the present invention, in order to enhance the advantageous effects of the present invention, the metal oxide microparticle is surface-modified with a hole-transporting compound having a structure represented by Formula (1). Since the surfaces of the metal oxide microparticles thereby have high reactivity to hydroxy groups, the hole injectability from the charge-transporting layer into the surface protective layer is enhanced, and the metal oxide microparticles can exhibit high hole transportability in the surface protective layer.

The hole-transporting compound having a structure represented by Formula (1) preferably has a structure represented by Formula (2). In such a case, since the surfaces of the metal oxide microparticles have higher reactivity to hydroxy groups, the hole injectability from the charge-transporting layer into the surface protective layer is enhanced, and the metal oxide microparticles can exhibit high hole transportability in the surface protective layer.

The acidic group represented by $Q_2$ or $Q_3$ in Formula (2) is preferably a carboxy, phosphonate, phosphinate, or sulfonate group. In such a case, the surfaces of the metal oxide microparticles have satisfactory reactivity to hydroxy groups, and self-condensation reaction does not occur.

The binder resin contained in the surface protective layer is preferably prepared by polymerization of a crosslinkable polymerizable compound. Such a binder resin has a high hardness to give a strong surface protective layer.

The crosslinkable polymerizable compound preferably has an acryloyl group or a methacryloyl group. Such a polymerizable compound has high reactivity and can readily form a strong surface protective layer by photo- or thermo-polymerization.

The metal oxide microparticle is preferably surface-modified with a hole-transporting compound represented by Formula (1) and a coupling agent having a polymerizable reactive group. Such microparticles exhibit high dispensability in the surface protective layer and can form a strong coating film and also can further enhance the hole transportability in the surface protective layer.

The coupling agent having a polymerizable reactive group is preferably a silane coupling agent having a polymerizable reactive group. Such a coupling agent has high reactivity to the metal oxide microparticle and has enhanced dispensability in the surface protective layer and can form a strong surface protective layer.

The metal oxide microparticle is preferably a $SnO_2$ microparticle, $TiO_2$ microparticle, $Al_2O_3$ microparticle, or $CuAlO_2$ microparticle. Such a microparticle has high reactivity to the hole-transporting compound having a structure represented by Formula (1) and a silane coupling agent.

The components of the present invention and embodiments implementing the present invention will now be described in detail. It should be noted that, throughout the specification, the term "to" indicating the numerical range is meant to be inclusive of the lower and upper limits represented by the numerals given before and after the term, respectively.

<<Ionization Potential>>

The present invention is characterized in that the ionization potential ($IP_A$) of the charge-transporting material contained in the charge-transporting layer and the ionization potential ($IP_B$) of the metal oxide microparticle contained in the surface protective layer satisfy the relationship represented by Expression (A):

$$-0.4\ \text{eV} \leq (IP_A - IP_B) \leq 0.4\ \text{eV}.$$

The ionization potential ($IP_A$) and the ionization potential ($IP_B$) preferably satisfy the relationship represented by Expression (B):

$$-0.3\ \text{eV} \leq (IP_A - IP_B) \leq 0.3\ \text{eV}.$$

An ionization potential ($IP_A$) lower than the ionization potential ($IP_B$) by 0.4 eV or more ($-0.4\ \text{eV} < (IP_A - IP_B)$) leads to a large gap of the ionization potential at the interface between the charge-transporting layer and the surface protective layer, a high injection barrier of charge (holes) from the charge-transporting layer to the surface protective layer, and thus low charge-injecting efficiency. As a result, charge is trapped at the interface between the charge-transporting layer and the surface protective layer, image memory is not reduced. An ionization potential ($IP_A$) higher than the ionization potential ($IP_B$) by 0.4 eV or more ($0.4\ \text{eV} < (IP_A - IP_B)$) leads to a significantly low ionization potential of the metal oxide microparticles contained in the surface protective layer, which accelerates oxidation of the microparticles and image blurring.

In order to control the difference between the ionization potentials ($IP_A$) and ($IP_B$) within the above-mentioned range, the ionization potential ($IP_B$) of the metal oxide microparticle contained in the surface protective layer is preferably within a range of $5.2\ \text{eV} \leq IP_B \leq 5.8\ \text{eV}$. An ionization potential ($IP_B$) within this range leads to superior hole injection from the charge-transporting layer, and delayed oxidation.

The ionization potential ($IP_A$) of the charge-transporting material contained in the charge-transporting layer is preferably within a range of $5.3\ \text{eV} \leq IP_A \leq 5.7\ \text{eV}$. An ionization potential ($IP_A$) within this range leads to superior hole injection from the charge-transporting layer, and hole transportation in the charge-transporting layer.

At ionization potentials ($IP_A$) and ($IP_B$) within the above-mentioned ranges, charge is efficiently injected from the charge-transporting layer to the surface protective layer to significantly reduce the image memory effect and delay oxidation of the metal oxide microparticles. As a result, image blurring can be reduced.

(Measurement of Ionization Potential)

The ionization potential ($IP_A$) of the charge-transporting material contained in the charge-transporting layer and the ionization potential ($IP_B$) of the metal oxide microparticle contained in the surface protective layer can be measured with a photoelectron spectrometer in air "AC-3" (manufactured by Riken Keiki Co., Ltd.) under the following measuring conditions.

[Measuring Conditions]

Measuring light intensity: 10 nW,
Counting time: 5 sec,
Anode voltage: 2950 V,
Starting energy: 4 eV,
Ending energy: 7 eV, and
Stepwise increase: 0.05 eV.

A powdered sample (metal oxide microparticles or hole-transporting material) is put in a sampling stage having a diameter of 10 mm and a depth of 1 mm or 0.5 mm in an amount of just the sample stage capacity and is then irradiated with 10 nW of light (excitation light) from a deuterium lamp dispersed with a monochromator. The emitted photoelectrons are measured with an electrometer every 0.05 eV from a starting energy of 4 ev to an ending energy of 7 eV. The ionization potential can be determined as a threshold of photoelectron emission that is determined by extrapolation from an irradiated photon energy curve of the resulting photoelectron emission.

<<Electrophotographic Photoreceptor>>

The electrophotographic photoreceptor of the present invention at least includes a charge-generating layer, a charge-transporting layer, and a surface protective layer sequentially deposited on an electroconductive support, and is characterized in that the charge-transporting layer contains a charge-transporting material, the surface protective layer contains a binder resin and a metal oxide microparticle, and the ionization potential ($IP_A$) of the charge-transporting material contained in the charge-transporting layer and the ionization potential ($IP_B$) of the metal oxide microparticle contained in the surface protective layer satisfy the relationship represented by Expression (A):

$$-0.4\ \text{eV} \leq (IP_A - IP_B) \leq 0.4\ \text{eV}.$$

The electrophotographic photoreceptor of the present invention includes a charge-generating layer having a function of absorbing light and generating charge, a charge-transporting layer having a function of transporting charge, and a surface protective layer sequentially deposited on an electroconductive support. As shown below, an intermediate layer is optionally disposed between the electroconductive support and the charge-generating layer. The electrophotographic photoreceptor of the present invention has the following layer configuration:

A layer configuration (1) composed of a charge-generating layer, a charge-transporting layer, and a surface protective layer sequentially deposited on an electroconductive support; or A layer configuration (2) composed of an intermediate layer, a charge-generating layer, a charge-transporting layer, and a surface protective layer sequentially deposited on an electroconductive support.

Although the photoreceptor of the present invention may have either the layer configuration (1) or (2), particularly preferred is a layer configuration prepared by sequentially laminating an intermediate layer, a charge-generating layer, a charge-transporting layer, and a surface protective layer on an electroconductive support.

FIG. 1 is a schematic diagram illustrating an example layer configuration of a photoreceptor of the present invention. In FIG. 1, reference numeral 1 denotes an electroconductive support, reference numeral 2 denotes a photosensitive layer, reference numeral 3 denotes an intermediate layer, reference numeral 4 denotes a charge-generating layer, reference numeral 5 denotes a charge-transporting layer, reference numeral 6 denotes a surface protective layer, and reference numeral 7 denotes metal oxide microparticles.

The configurations of the surface protective layer, electroconductive support, intermediate layer, and photosensitive layer (charge-generating layer and charge-transporting layer) of the photoreceptor of the present invention will now be described.

<<Surface Protective Layer>>

The surface protective layer according to the present invention contains a binder resin and metal oxide microparticles. The materials constituting the surface protective layer will be described.

<Metal Oxide Microparticle>

The metal oxide microparticles contained in the photoreceptor of the present invention preferably have an ionization potential ($IP_B$) within a range of 5.2 eV≤$IP_B$≤5.8 eV. The metal oxide microparticles are preferably surface-modified with a hole-transporting compound having a structure represented by Formula (1) (hereinafter, such metal oxide microparticles are also referred to as "surface-modified metal oxide microparticles"). The metal oxide microparticles are preferably composed of tin oxide ($SnO_2$), titanium dioxide ($TiO_2$), alumina ($Al_2O_3$), or copper aluminate ($CuAlO_2$). These metal oxide microparticles having an ionization potential within the above-mentioned range is preferred because they can be uniformly dispersed in the surface protective layer and can increase the strength of the surface protective layer.

<Surface-Modified Metal Oxide Microparticles>

In the present invention, the metal oxide microparticles contained in the surface protective layer is preferably surface-modified with a hole-transporting compound having a structure represented by Formula (1). The ionization potential ($IP_B$) of the surface-modified metal oxide microparticles can be controlled by the hole-transporting compound modifying the surface of the metal oxide microparticles.

(Hole-Transporting Compound)

The hole-transporting compound having a structure represented by Formula (1), which modifies the surfaces of the metal oxide microparticles according to the present invention, will be described.

[Chem. 3]

$$A\text{-}(R_1\text{-}Q_1)_k \qquad \text{Formula(1)}$$

In Formula (1), A represents a hole transportable group; $Q_1$ represents an acidic group; $R_1$ represents a substituted or unsubstituted alkylene, alkenylene, alkynylene, or arylene group; and k represents a positive integer of 1 or more, where when k is an integer of 2 or more, $R_1$'s may be the same or different, and $Q_1$'s may be the same or different.

In Formula (1), A represents a hole transportable group. The hole transportable group may be any group having a hole-transporting ability. When the hole transportable group is indicated as a hydrogenated compound (hole-transporting compound) by replacing the site binding to $R_1$ in Formula (1) with a hydrogen atom, examples of the hole-transporting compound include oxazole derivatives, oxadiazole derivatives, imidazole derivatives, triarylamine derivatives such as triphenylamine, styryltriphenylamine derivatives, distyryltriarylamine derivatives, tristyryltriarylamine derivatives, styrylanthracene derivatives, styrylpyrazoline derivatives, phenylhydrazones, triazole derivatives, thiadiazole derivatives, triazole derivatives, phenazine derivatives, acridine derivatives, benzofuran derivatives, benzimidazole derivatives, thiophene derivatives, and N-phenylcarbazole derivatives. Among these compounds, preferred are triarylamine derivatives, styryltriarylamine derivatives, and distyryltriarylamine derivatives.

$R_1$ represents an alkylene, alkenylene, alkynylene, or arylene group. The alkylene group has 1 to 4 carbon atoms and is preferably a methylene group. The alkenylene group has 2 to 4 carbon atoms and is preferably a vinylene or propenylene group. The alkynylene group has 2 to 4 carbon atoms and is preferably an ethynylene, propynylene, or butynylene group. The arylene group is preferably a phenylene or naphthylene group. The substituent of the alkylene, alkenylene, or alkynylene group is an alkyl group having 1 to 4 carbon atoms, a chlorine atom, a bromine atom, a cyano group, or a substituted or unsubstituted amino group. The substituent of the arylene group is an alkyl group having 1 to 4 carbon atoms, a chlorine atom, a bromine atom, or a substituted or unsubstituted amino group.

The hole-transporting compound having a structure represented by Formula (1) is preferably a compound having a structure represented by Formula (2).

[Chem. 4]

Formula (2)

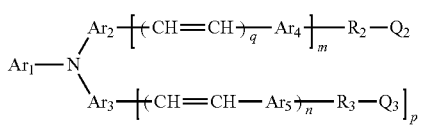

In Formula (2), $Ar_1$ represents a substituted or unsubstituted aryl group. Preferred examples of the aryl group include a phenyl group and a naphthyl group. The substituent of the aryl group is an alkyl group having 1 to 5 carbon atoms, a substituted or unsubstituted aryl group, a substituted or unsubstituted alkenylene group, a chlorine atom, a bromine atom, or a substituted or unsubstituted amino group. Preferred examples of the substituent are alkyl groups having 1 to 5 carbon atoms and substituted or unsubstituted aryl groups.

$Ar_2$, $Ar_3$, $Ar_4$, and $Ar_5$ each independently represent a substituted or unsubstituted arylene group. Preferred examples of the arylene group include phenylene groups and naphthylene groups. The substituent of the arylene group is an alkyl group having 1 to 5 carbon atoms, a chlorine atom, a bromine atom, or a substituted or unsubstituted amino group.

$R_2$ and $R_3$ may be the same or different, and examples thereof are the same as those of $R_1$ in Formula (1).

$Q_2$ and $Q_3$ may be the same or different, and represent an acidic group. The acidic group is a carboxy group, a phosphonate group, a phosphinate group, or a sulfonate group. Subscripts m, n, p, and q each independently represent 0 or 1. When p is 0, $Ar_3$ represents a substituted or unsubstituted aryl group. The substituent of the substituted aryl group represented by $Ar_3$ is an alkyl group having 1 to 5 carbon atoms, a substituted or unsubstituted aryl group, or a substituted or unsubstituted alkenylene group. Examples of the substituents of the aryl group and the alkenylene group include alkyl groups having 1 to 5 carbon atoms and substituted or unsubstituted aryl groups.

In the present invention, the acidic group represented by $Q_2$ or $Q_3$ is preferably a carboxy, phosphonate, phosphinate, or sulfonate group, which has high reactivity to the hydroxy groups of the surfaces of the metal oxide microparticles.

The surface protective layer according to the present invention contains metal oxide microparticles the surfaces of which are modified with a hole-transporting compound having a structure represented by Formula (1) (hereinafter, also simply referred to as "hole-transporting compound"), and the hole-transporting compound molecules are uniformly dispersed in the surface protective layer. The hole-transporting compound and the metal oxide microparticles have hole transportability, and thereby the holes can readily move in the surface protective layer, and the electrical characteristics, such as chargeability and sensitivity characteristics, of the electrophotographic photoreceptor are not deteriorated. The metal oxide microparticles uniformly dispersed in the surface protective layer can form a strong coating film due to their filler effect, which enhances the wear resistance of the surface protective layer and enhances the durability of the photoreceptor.

In detail, an acidic group, such as a carboxy group, forms an ionic bond with a hydroxy group on the surface of a metal oxide microparticle. The hole-transporting compound having a structure represented by Formula (1) includes acidic groups, such as carboxy groups, at its terminals. The acidic groups form ionic bonds with the hydroxy groups on the surfaces of the metal oxide microparticles. The metal oxide microparticles bound to the hole-transporting compound molecules via ionic bonds are uniformly dispersed in the surface protective layer. The effects of both the hole-transporting compound and the metal oxide microparticles can enhance the hole transportability of the surface protective layer and can form a strong coating film, resulting in a reduction in image memory. In addition, image blurring caused by electric discharge products, such as ozone and nitrogen oxide, can be prevented. Since the hole-transporting compound having a structure represented by Formula (1) has no self-condensing substituent, such as an alkoxysilane compound, self-condensation reaction does not occur, and impurities due to self-condensation are not generated. Thus, since the hole-transporting compound highly enhances the hole transportability in the surface protective layer, image memory is considerably reduced.

In contrast, a hole-transporting compound including an alkoxysilyl group (alkoxysilane compound) forms a silanol group by hydrolysis of the alkoxy group. This silanol group migrates to the surface of the metal oxide microparticle via a hydrogen bond with the hydroxy group on the surface of the metal oxide microparticle and forms a strong covalent bond with the surface of the metal oxide microparticle through dehydration condensation. Alternatively, the silanol group can form a siloxane bond through condensation with another silanol group. That is, a part of the alkoxysilane compound molecules does not react with the metal oxide microparticles but forms siloxane bonds with another alkoxysilane compound. Thus, self-condensation reaction occurs. In the case of using a hole-transporting compound including an alkoxysilyl group, only a part of the hole-transporting compound molecules is adsorbed to the surfaces of the metal oxide microparticles, and the effect of reducing image memory is low.

Specific examples of the hole-transporting compound having a structure represented by Formula (1) are shown below.

[Chem. 5]

[HTM-1]

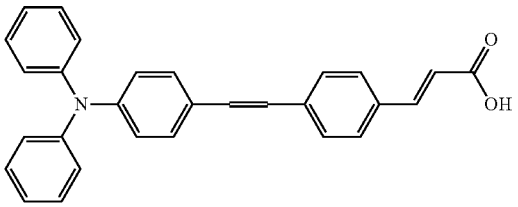

[HTM-2]

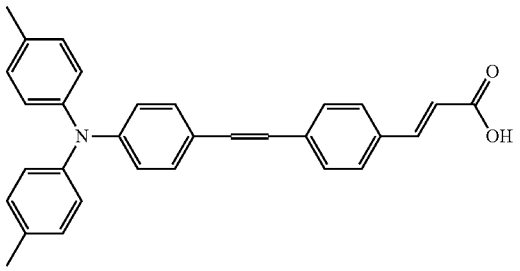

-continued
[HTM-3]
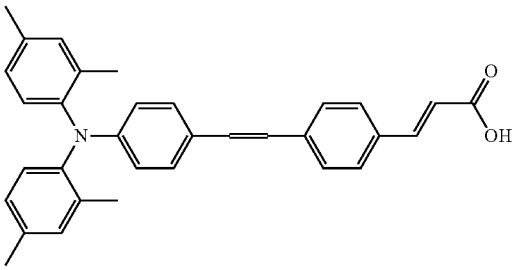
[HTM-4]
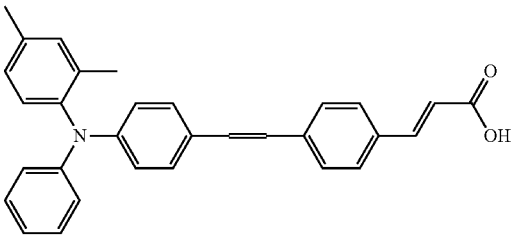
[HTM-5]
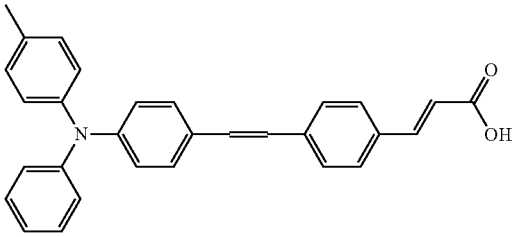
[Chem. 6]
[HTM-6]
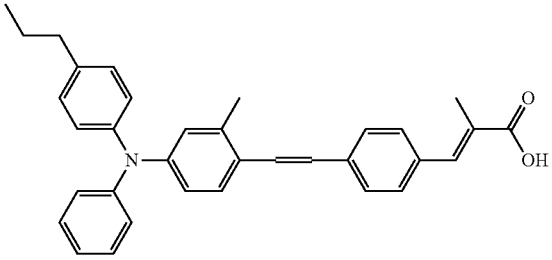
[HTM-7]
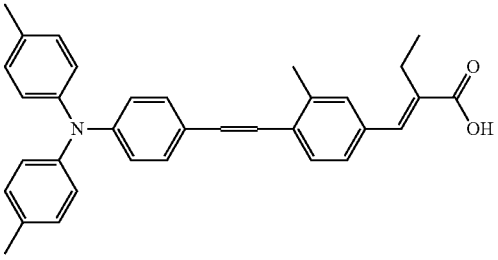
[HTM-8]
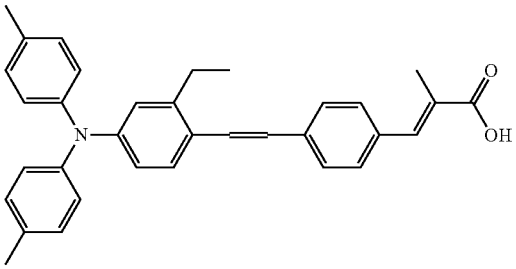
[HTM-9]
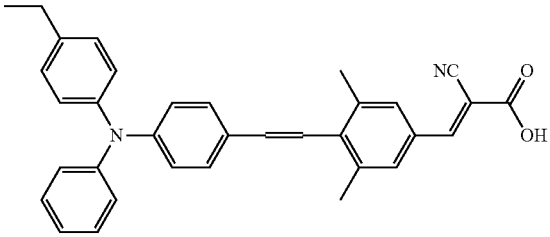
[HTM-10]
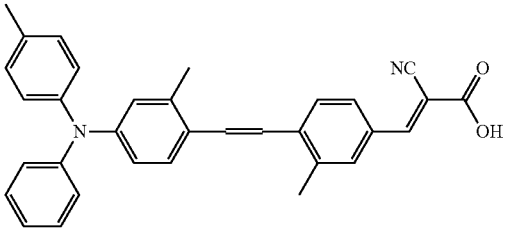

-continued
[Chem. 7]
[HTM-11]
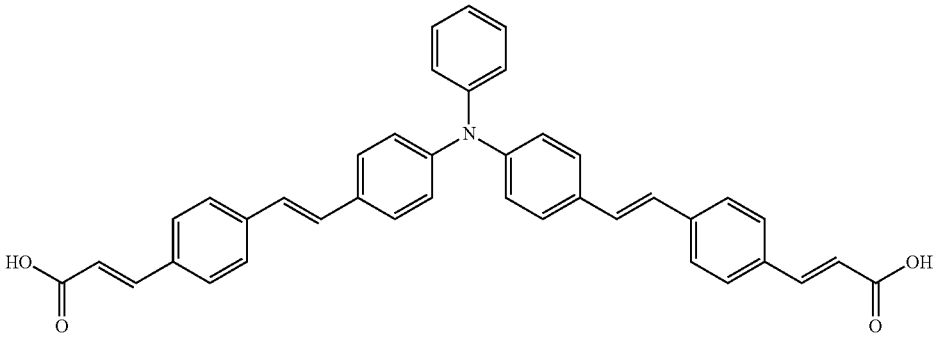
[HTM-12]
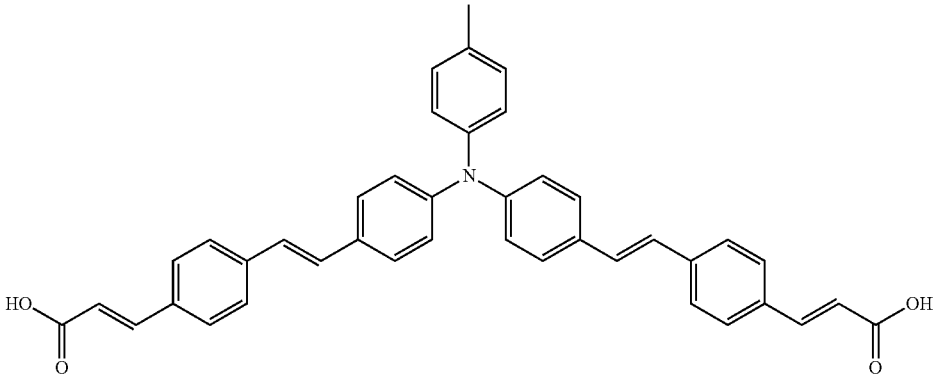
[HTM-13]
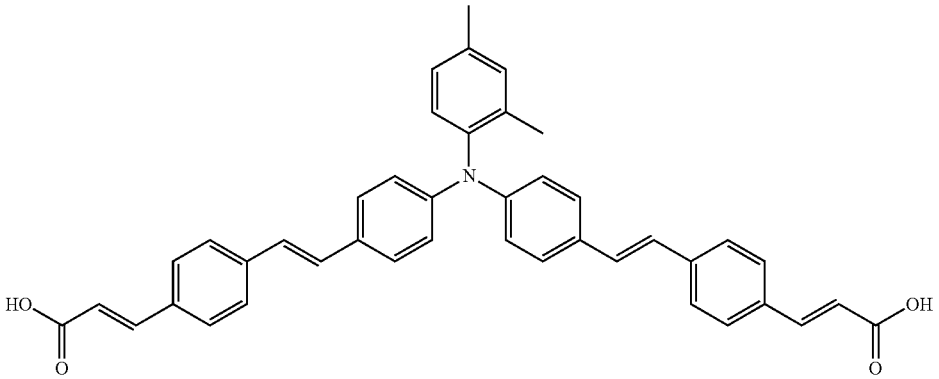
[HTM-14]
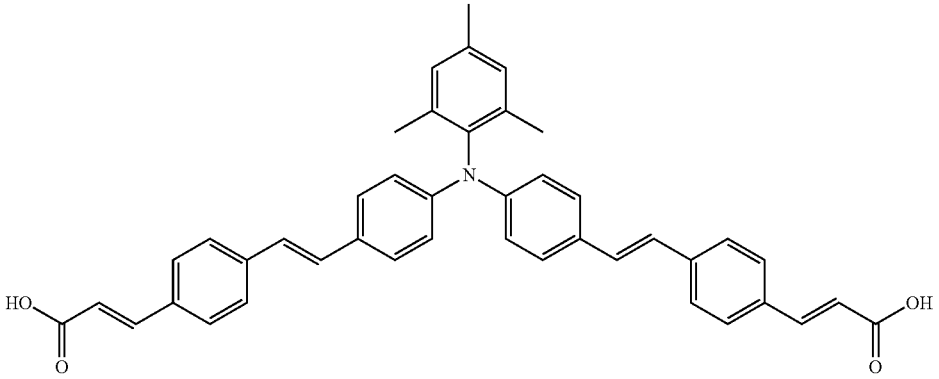

-continued
[HTM-15]
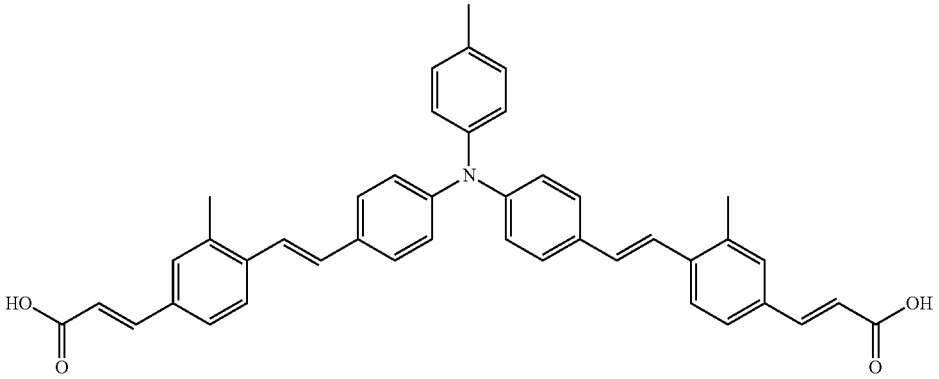
[Chem. 8]
[HTM-16]
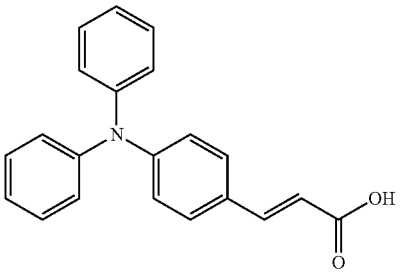
[HTM-17]
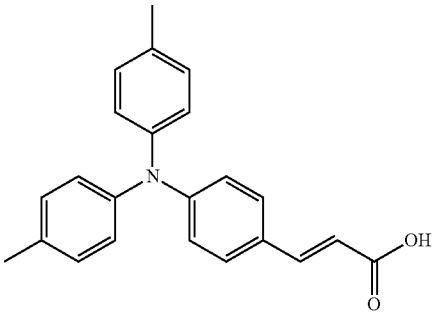
[HTM-18]
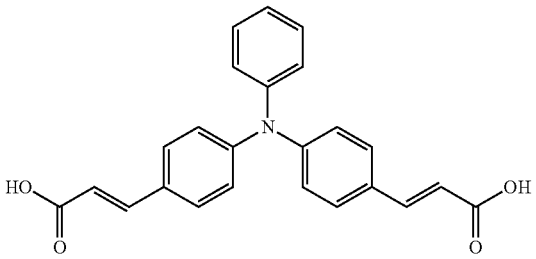
[HTM-19]
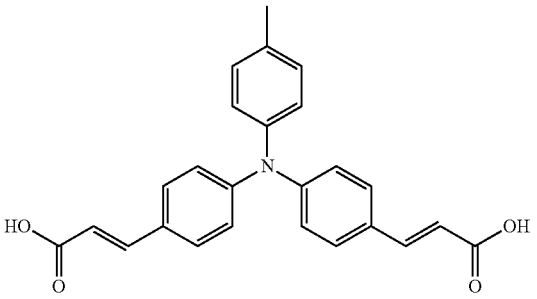
[HTM-20]
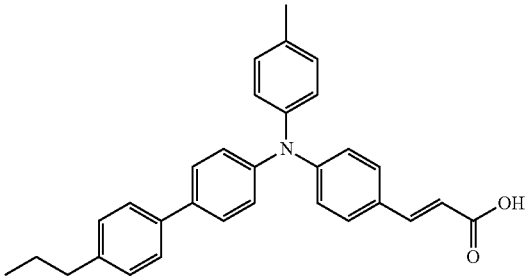

-continued
[Chem. 9]
[HTM-21]
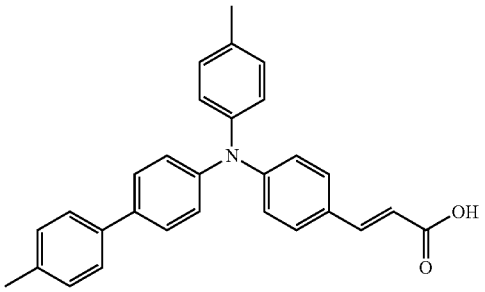
[HTM-22]
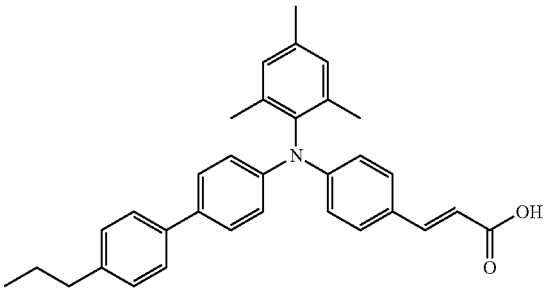
[HTM-23]
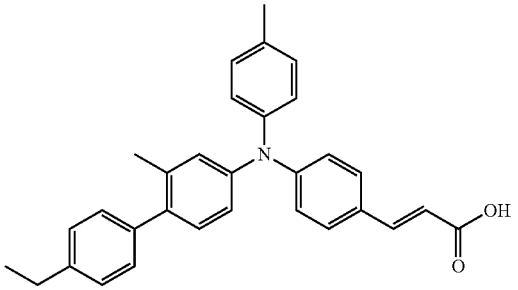
[HTM-24]
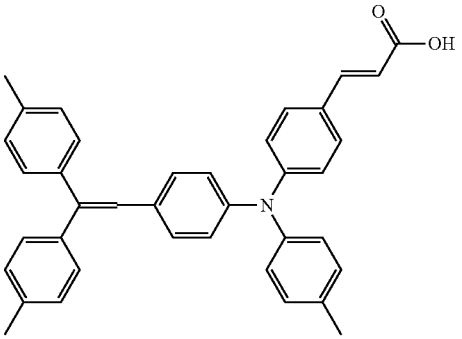
[HTM-25]
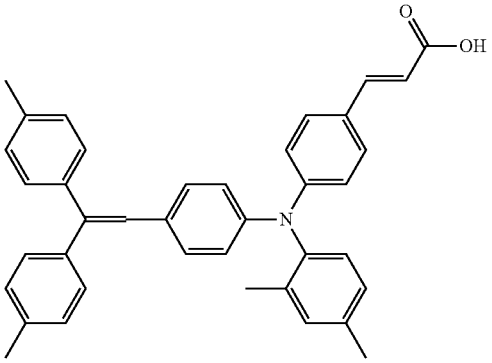
[Chem. 10]
[HTM-26]
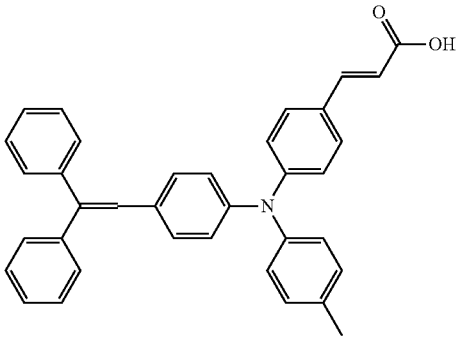
[HTM-27]
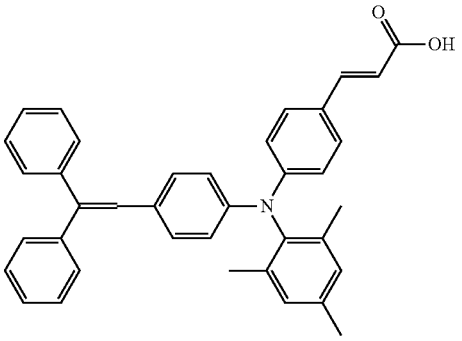

-continued
[HTM-28]
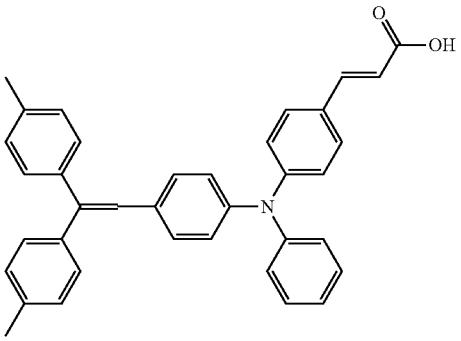
[HTM-29]
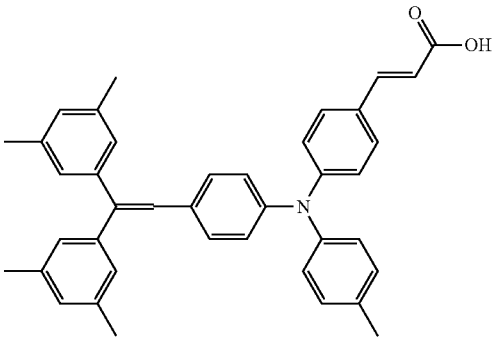
[HTM30]
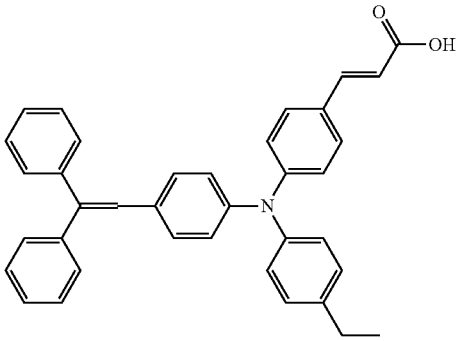
[Chem. 11]
[HTM-31]
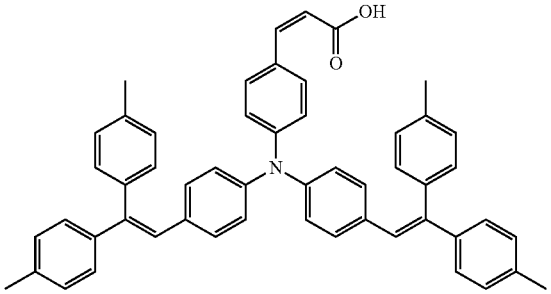
[HTM-32]
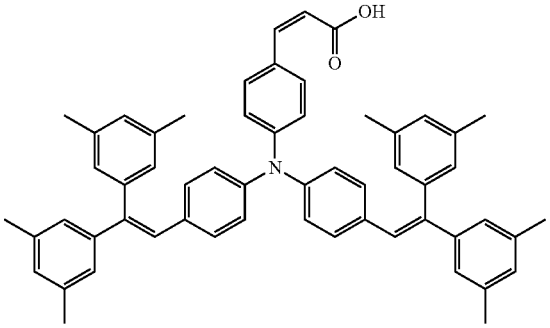
[HTM-33]
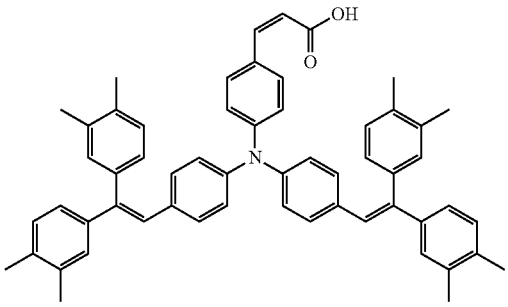
[HTM-34]
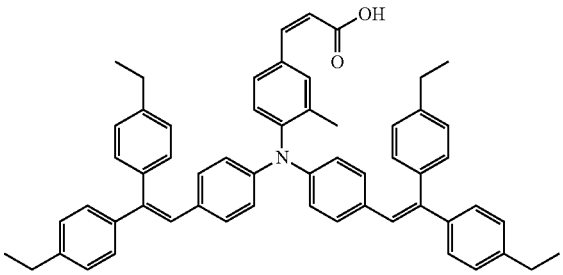

-continued
[HTM-35]
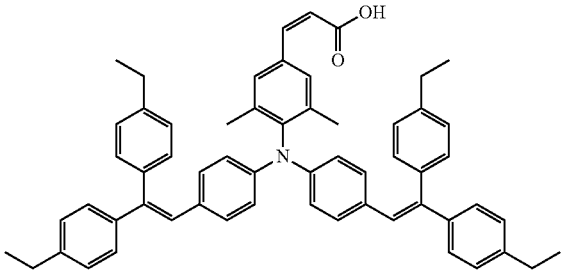
[Chem. 12]
[HTM-36]
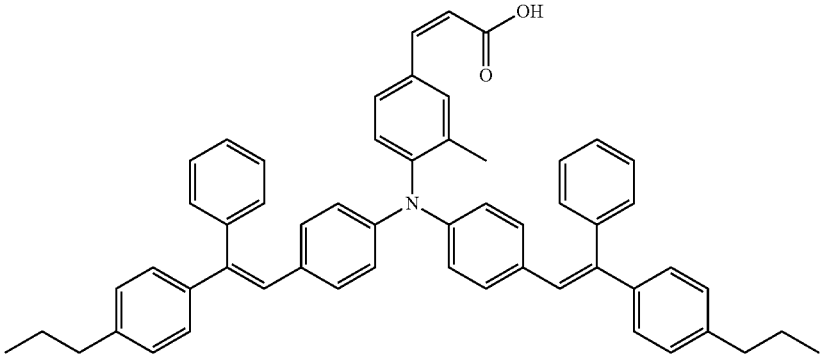
[HTM-37]
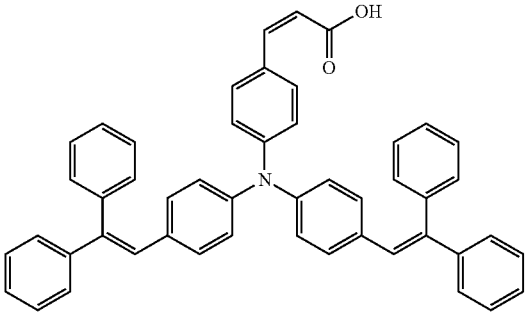
[HTM-38]
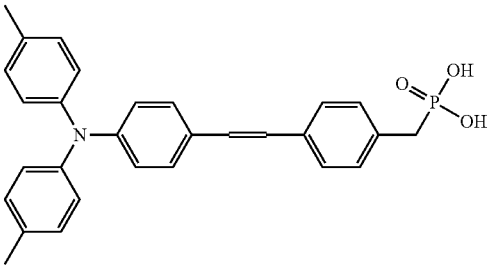
[HTM-39]
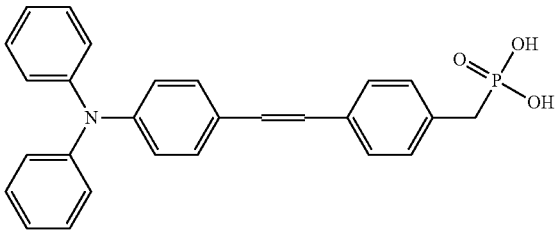
[HTM-40]
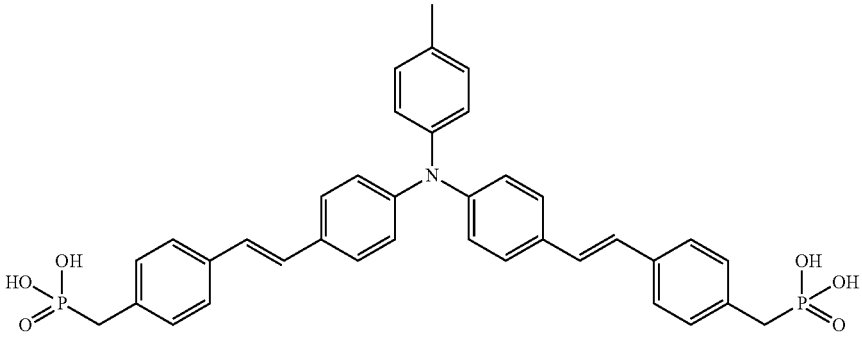

-continued
[HTM-41]
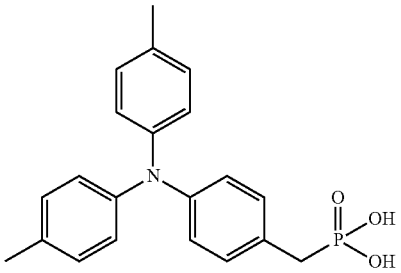
[HTM-42]
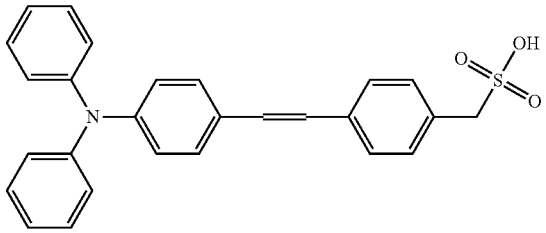
[HTM-43]
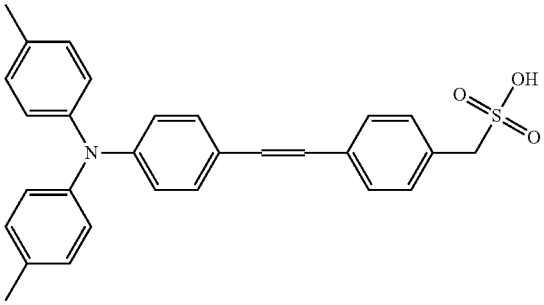
[HTM-44]
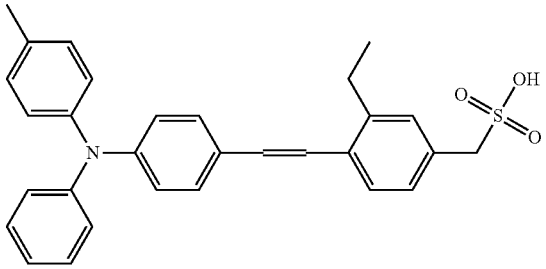
[HTM-45]
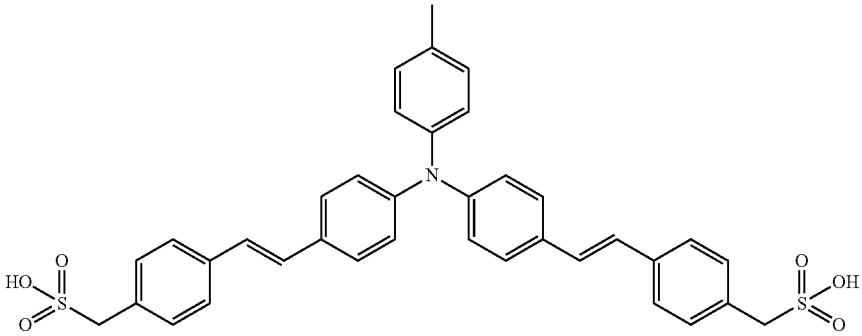
[Chem. 14]
[HTM-46]
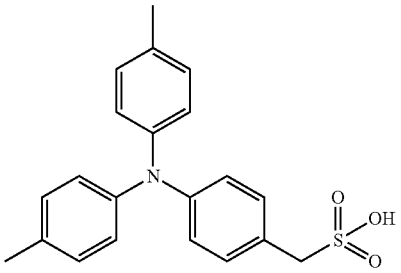
[HTM-47]
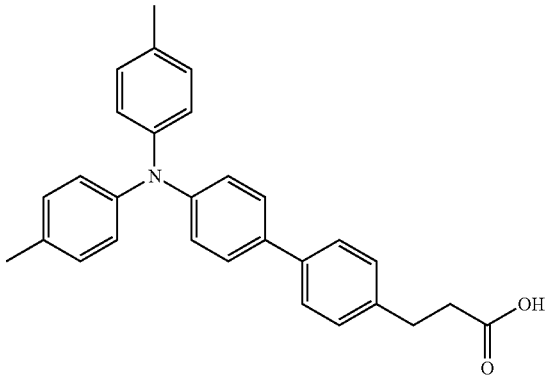

-continued
[HTM-48]
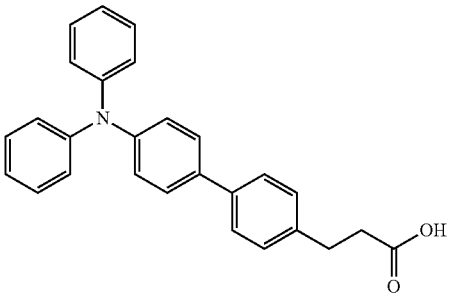
[HTM-49]
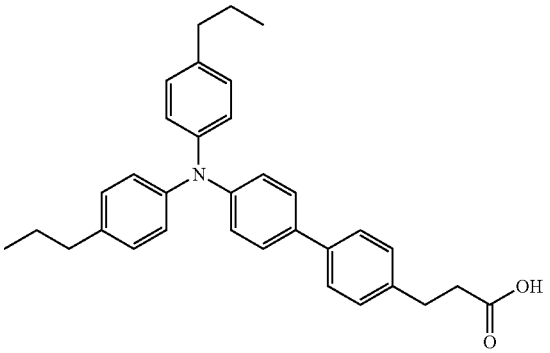
[HTM-50]
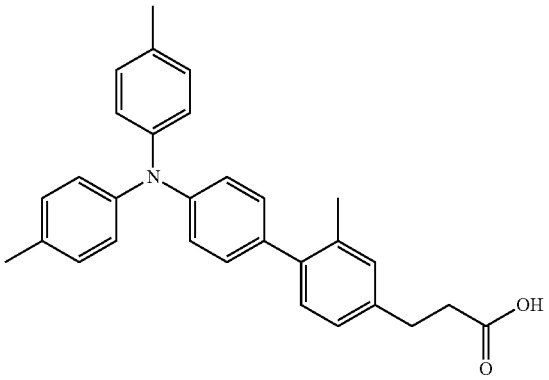
[Chem. 15]
[HTM-51]
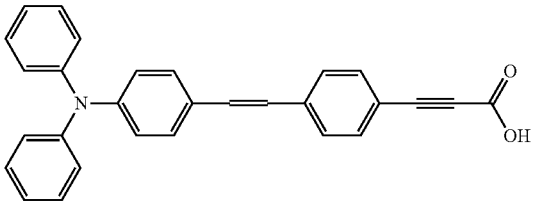
[HTM-52]
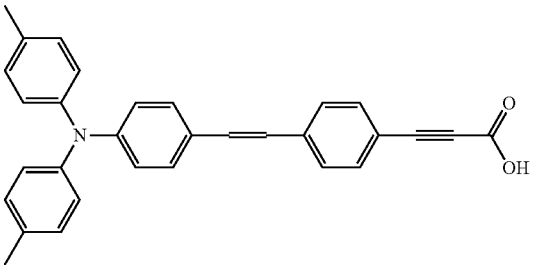
[HTM-53]
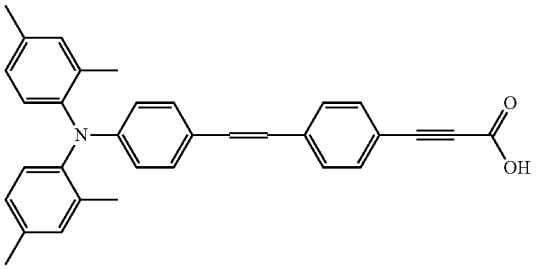
[HTM-54]
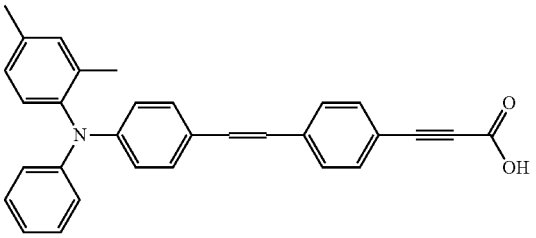
[HTM-55]
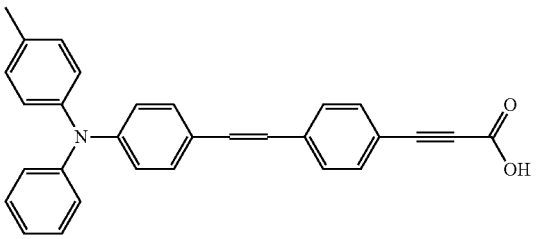

-continued
[Chem. 16]
[HTM-56]
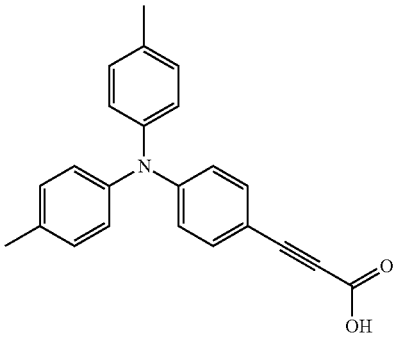
[HTM-57]
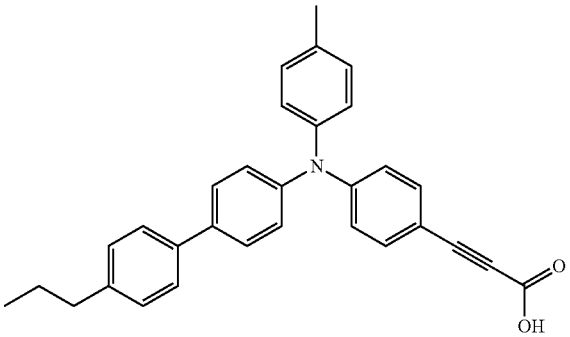
[HTM-58]
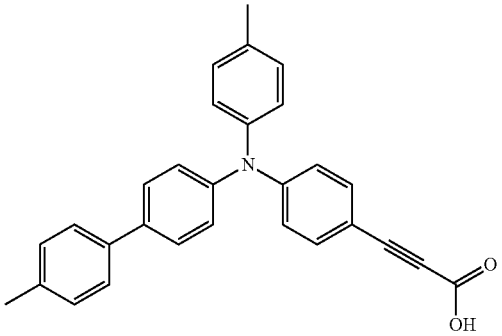
[HTM-59]
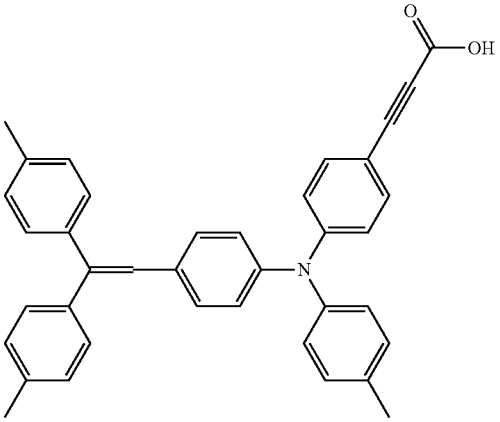
[HTM-60]
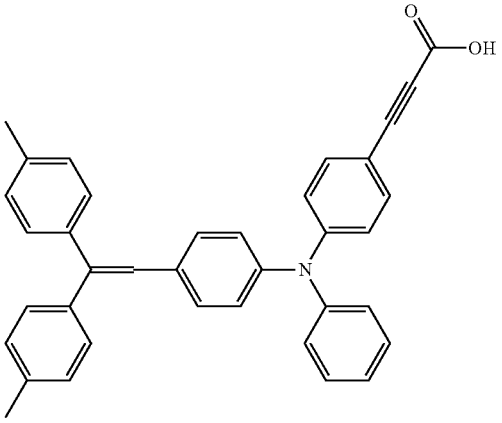

-continued
[Chem. 17]
[HTM-61]
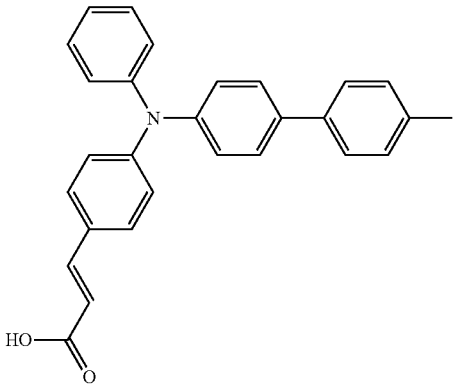
[HTM-62]
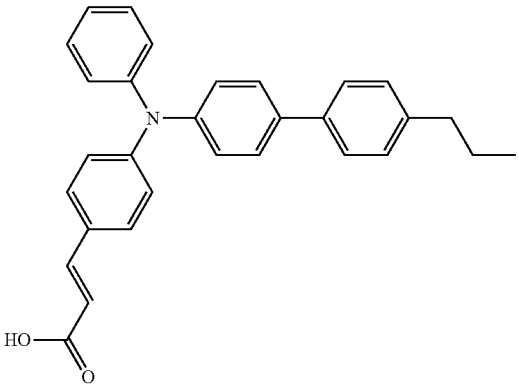
[HTM-63]
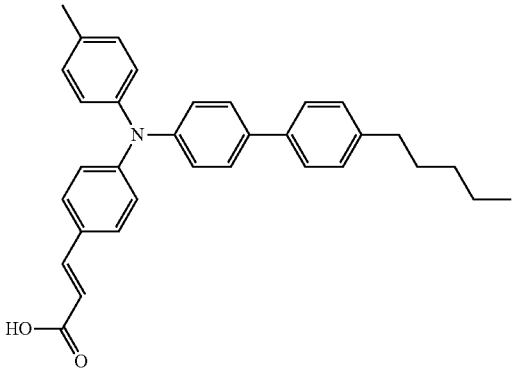
[HTM-64]
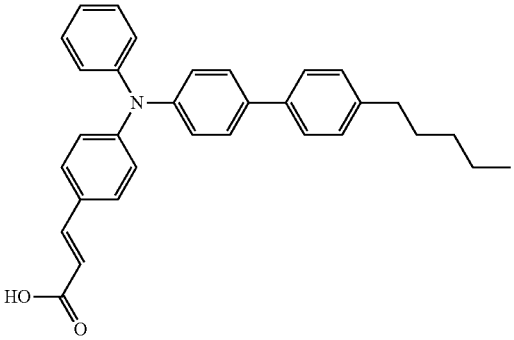
[HTM-65]
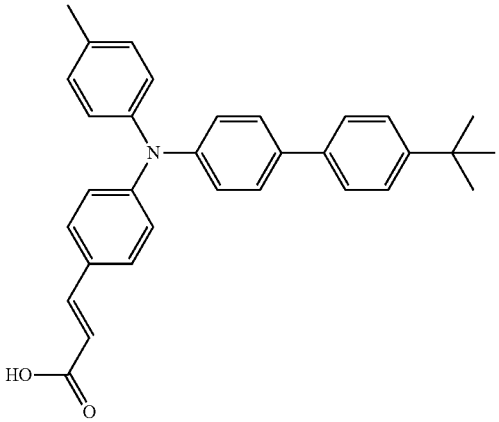
[HTM-66]
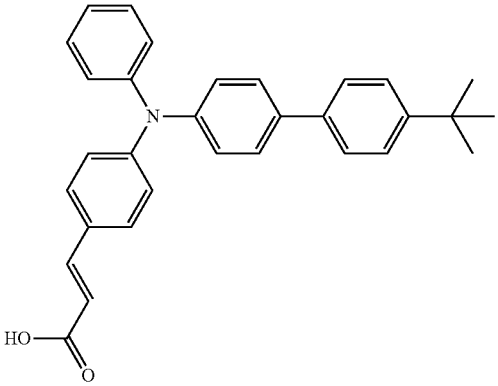

The hole-transporting compound having a structure represented by Formula (1) can be synthesized through a known process shown below.

Synthetic Process

Synthetic Example (1)

Process of Synthesizing Compound Example [HTM-1]

[Chem. 18]

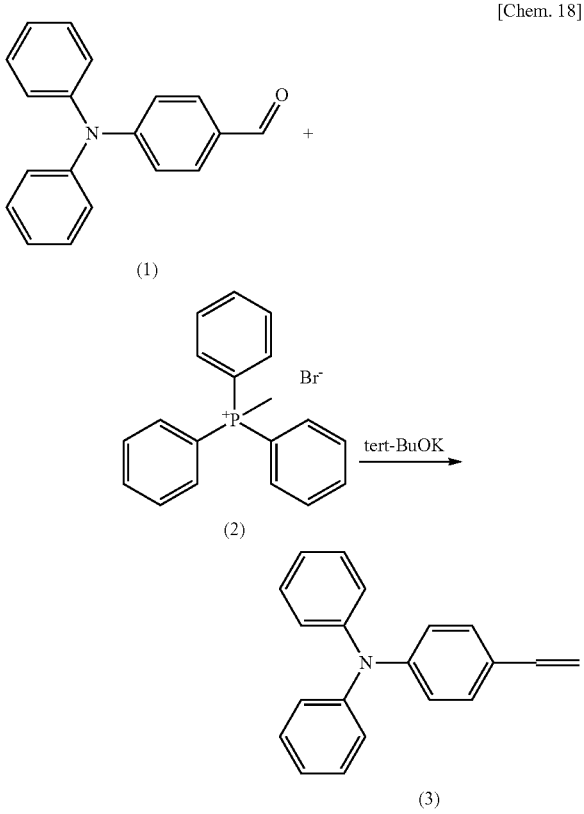

A 100-mL four-necked flask equipped with a nitrogen-introducing tube, a thermometer, a cooling tube, and a dropping funnel was fed with 30.8 g (0.086 mol) of methyltriphenylphosphonium bromide (2), 11.9 g (0.106 mol) of tert-butoxypotassium, and 15 mL of tetrahydrofuran (THF), followed by stirring under a nitrogen stream at room temperature for 1 hr.

Separately, 20 g (0.073 mol) of 4-(diphenylamino)benzaldehyde (1) was dissolved in 40 mL of THF. The solution was slowly dropwise added to the flask through the dropping funnel. After the addition, the reaction was performed at room temperature for 2 hr, followed by addition of 70 mL of water. The reaction product was extracted with ethyl acetate, and the extract was washed with water until a neutral condition was obtained. The organic layer was dried and concentrated, followed by purification by column chromatography to give 16 g (yield: 89%) of 4-(diphenylamino) styrene (3) as light yellow crystals.

[Chem. 19]

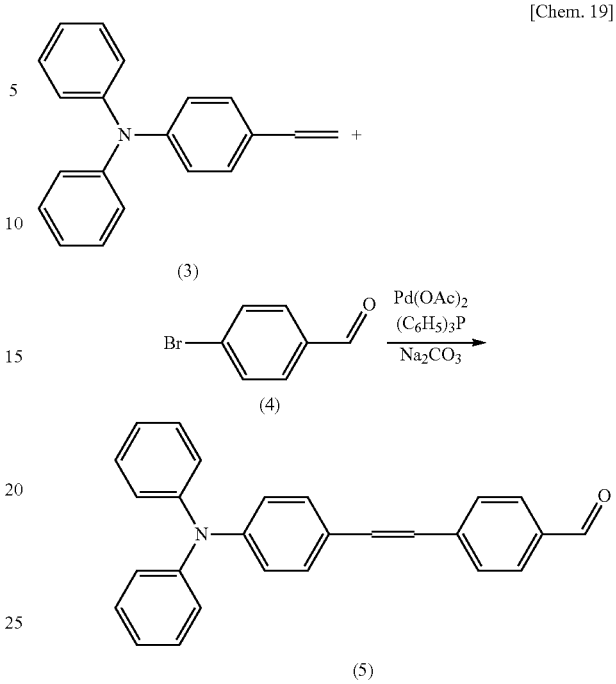

A 100-mL four-necked flask equipped with a nitrogen-introducing tube, a thermometer, a cooling tube, and a dropping funnel was fed with a solution of 5 g (0.018 mol) of 4-(diphenylamino)styrene (3) in 25 mL of N,N-dimethylacetamide (DMA), 3.7 g (0.02 mol) of 4-bromobenzaldehyde (4), 0.17 g (0.74 mmol) of palladium acetate, 0.77 g (2.95 mmol) of triphenylphosphine, and 3.12 g (0.029 mol) of sodium carbonate, followed by reaction under a nitrogen stream at 110° C. for 12 hr.

The reaction solution was cooled to room temperature, and 70 mL of water was added thereto. The reaction product was extracted with ethyl acetate, and the extract was washed with water until a neutral condition was obtained. The organic layer was dried and concentrated, followed by purification by column chromatography to give 5.9 g (yield: 89%) of a compound (5) as yellow crystals.

[Chem. 20]

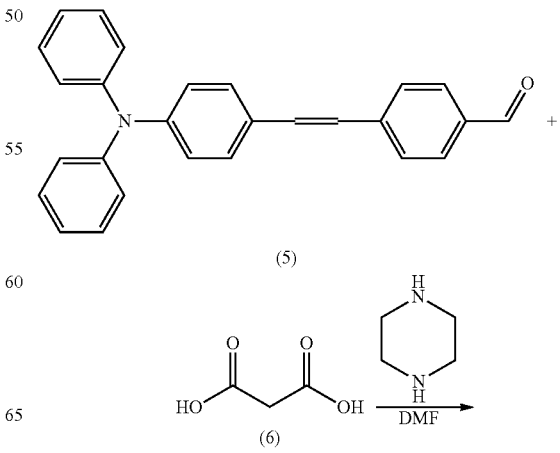

-continued

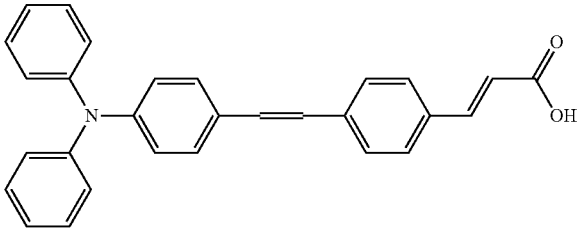

[HTM-1]

A 100-mL four-necked flask equipped with a nitrogen-introducing tube, a thermometer, a cooling tube, and a dropping funnel was fed with 5 g (0.013 mol) of the compound (5), 1.7 g (0.016 mol) of malonic acid (6), 0.57 g (0.007 mol) of piperazine, and 33 mL of dimethylformamide (DMF), followed by reaction under a nitrogen stream at 125° C. for 6 hr. The reaction solution was cooled to 100° C. or less, and an aqueous solution of 10% sulfuric acid was dropwise added thereto over 30 min, followed by stirring for 30 min. The reaction product was extracted with ethyl acetate, and the extract was washed with water until a neutral condition was obtained. The organic layer was dried and concentrated, followed by purification by column chromatography to give 5.5 g (yield: 98%) of [HTM-1] as yellow crystals.

The resulting compound was identified as [HTM-1] by nuclear magnetic resonance spectroscopy ($^1$H-NMR).

$^1$H-NMR (300 MHz, DMSO) δ ppm: 6.27 (d, 2H), 7.00-7.45 (m, 19H), 7.89 (d, 2H), 12.05 (d, 1H)

Synthetic Example (2)

Process of Synthesizing Compound Example [HTM-20]

[Chem. 21]

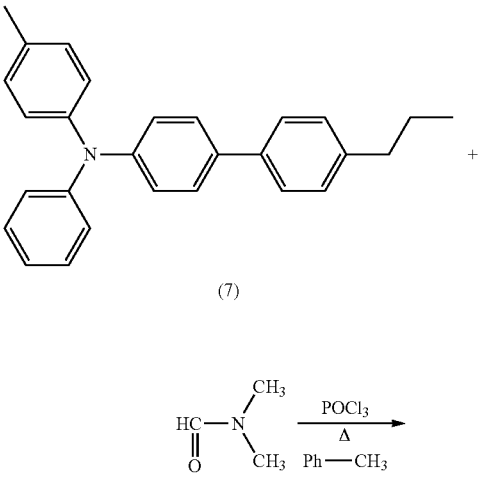

-continued

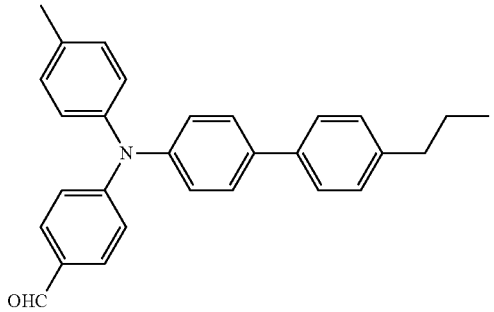

(8)

A 200-mL four-necked flask equipped with a thermometer, a cooling tube, and a dropping funnel was fed with 10 g (0.026 mol) of N-phenyl-4'-propyl-N-(p-tolyl)-[1,1'-biphenyl]-4-amine (7), 7.74 g (0.106 mol) of N,N'-dimethylformamide, and 45 mL of toluene, followed by complete dissolution. Subsequently, 12.2 g (0.08 mol) of phosphoryl chloride was slowly dropwise added to the flask through the dropping funnel, while the internal temperature being maintained at 20° C. to 30° C. After the completion of dropping, the reaction mixture was heated. The internal temperature was maintained at 50±5° C. for 10 hr. After the completion of the reaction, the reaction solution was added to a mixture of 180 mL of water and 30 mL of toluene with stirring, while the internal temperature being maintained at 40° C. to 50° C. After the addition, the reaction mixture was stirred at room temperature for 1 hr. The reaction solution was transferred to a separatory funnel and was washed with water until a neutral condition was obtained. The toluene layer was dried and concentrated, followed by recrystallization from a mixture of acetonitrile and water (3:1, volume ratio) to give 10.4 g (yield: 96.7%) of 4-((4'-propyl-[1,1'-biphenyl]-4-yl)(p-tolyl)amino)benzaldehyde (8) as yellow crystals.

[Chem. 22]

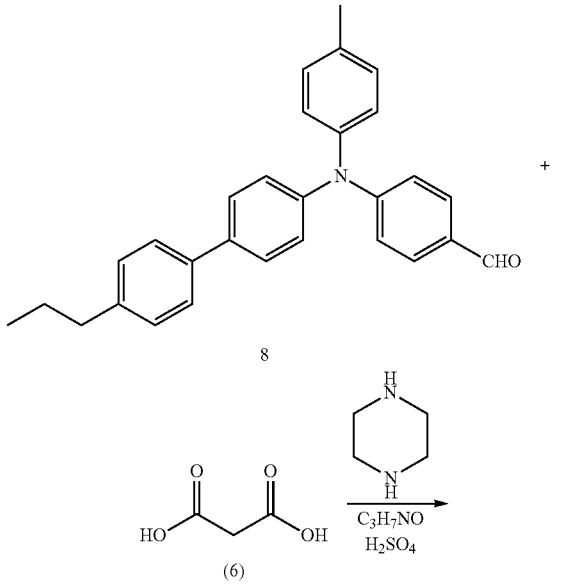

-continued

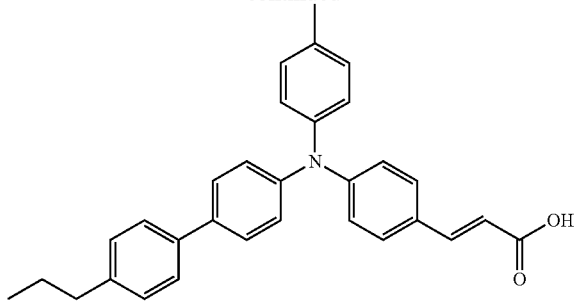

[HTM-20]

A 200-mL four-necked flask equipped with a thermometer, a cooling tube, and a dropping funnel was fed with 5 g (0.012 mol) of 4-((4'-propyl-[1,1'-biphenyl]-4-yl)(p-tolyl)amino)benzaldehyde (8), 1.54 g (0.015 mol) of malonic acid (6), 1.27 g (0.015 mol) of piperazine, and 30 mL of N,N-dimethylformamide (DMF), followed by reaction at 126° C. for 6 hr.

After the completion of the reaction, the internal temperature was cooled to 75° C., and 10 mL of an aqueous solution of 10% sulfuric acid was dropwise added thereto. The reaction mixture was then stirred for 30 min, and 50 mL of water was added thereto. The reaction product was extracted with ethyl acetate. The organic layer was dried and concentrated, followed by purification by column chromatography.

The product was 4.32 g (yield: 78.3%) of (E)-3-(4-((4'-Propyl-[1,1'-biphenyl]-4-yl)(p-tolyl)amino)phenyl)acrylic acid [HTM-20] as yellow crystals.

This compound was identified as [HTM-20] by nuclear magnetic resonance spectroscopy ($^1$H-NMR).

$^1$H-NMR (300 MHz, DMSO) δ ppm: 0.94 (m, 3H), 1.64 (m, 2H), 2.32 (s, 3H), 2.6 (m, 2H), 6.3 (m, 1H), 7.13-7.62 (m, 14H), 7.77 (d, 2H), 12.10 (d, 1H)

Synthetic Example (3)

Process of Synthesizing Compound Example [HTM-39]

[Chem. 23]

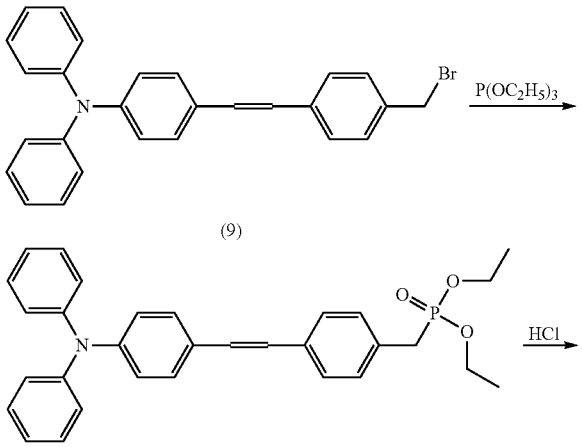

(9)

(10)

-continued

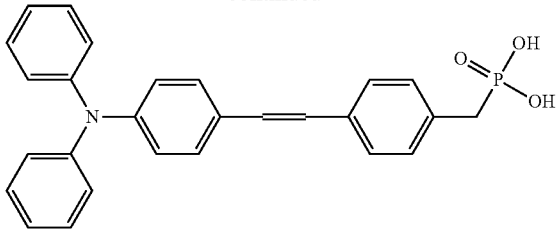

[HTM-39]

A 100-mL four-necked flask equipped with a thermometer, a cooling tube, and a dropping funnel was fed with 5 g (0.011 mol) of compound (9), and 9.0 g (0.055 mol) of triethyl phosphite was slowly dropwise added thereto. The temperature of the reaction mixture was gradually increased, followed by reflux for 6 hr. After the completion of the reaction, extra triethyl phosphite was distilled away under reduced pressure. The resulting target product was purified by column chromatography to give 4.7 g (yield: 83%) of compound (10). This compound (10) was refluxed together with 10 mL of concentrated hydrochloric acid for 24 hr to give 3.6 g (yield: 86%) of [HTM-39].

This compound was identified as [HTM-39] by nuclear magnetic resonance spectroscopy ($^1$H-NMR).

$^1$H-NMR (300 MHz, DMSO) δ ppm: 2.94 (d, 2H), 4.80 (s, 2H), 7.00-7.24 (m, 16H), 7.71 (d, 2H), 7.89 (d, 2H)

Synthetic Example (4)

Process of Synthesizing Compound Example [HTM-42]

[Chem. 24]

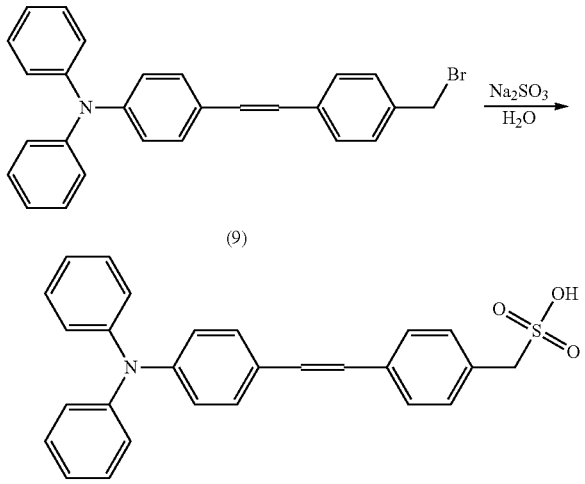

(9)

[HTM-42]

A 50-mL four-necked flask equipped with a thermometer and a cooling tube was fed with 5 g (0.011 mol) of compound (9), 1.9 g (0.015 mol) of sodium sulfite, and 15 mL of water, followed by reflux for 12 hr. After the completion of the reaction, the resulting target product was purified by column chromatography to give 3.9 g (yield: 81%) of [HTM-42].

This compound was identified as [HTM-42] by nuclear magnetic resonance spectroscopy ($^1$H-NMR).

$^1$H-NMR (300 MHz, DMSO) δ ppm: 4.29 (s, 1H), 7.00-7.24 (m, 16H), 7.71 (d, 2H), 7.89 (d, 2H), 8.5 (s, 1H)

Synthetic Example (5)

Process of Synthesizing Compound Example [HTM-52]

[Chem. 25]

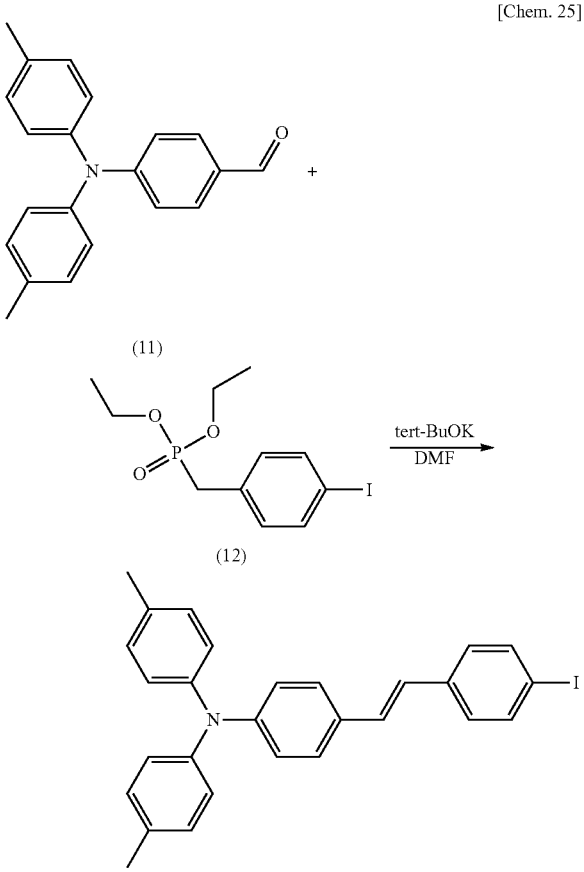

A 100-mL four-necked flask equipped with a nitrogen-introducing tube, a thermometer, and a cooling tube was fed with 5 g (16.6 mmol) of 4-(di-p-toluylamino)benzaldehyde (11), 7.64 g (21.6 mmol) of diethyl(4-iodobenzyl)phosphonate (12), and 15 mL of N,N-dimethylformamide, followed by sufficient dissolution under a nitrogen stream.

Subsequently, 2.98 g (26.5 mmol) of tert-butoxypotassium was gradually added to the solution, followed by reaction at 45° C. for 1 hr. After addition of 70 mL of water, the reaction product was extracted with ethyl acetate and was washed with water until a neutral condition was obtained.

The organic layer was dried and concentrated. The reaction product was purified by column chromatography to give 8.0 g (yield: 96.2%) of (E)-4-(4-iodostyryl)-N,N-di-p-toluylaniline (13) as light yellow crystals.

[Chem. 26]

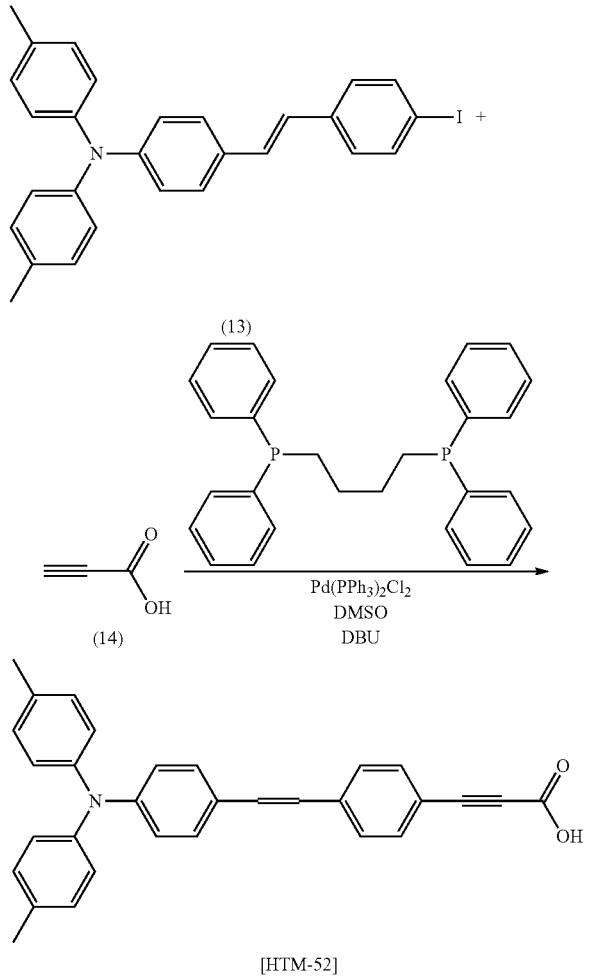

[HTM-52]

A 100-mL four-necked flask equipped with a nitrogen-introducing tube, a thermometer, and a cooling tube was fed with 7.0 g (14 mmol) of (E)-4-(4-iodostyryl)-N,N-di-p-toluylaniline (13), 235.1 mg (0.335 mmol) of $Pd(PPh_3)_2Cl_2$, 0.3 g (0.07 mmol) of 1,4-bis(diphenylphosphino)butane, 10.6 g (0.07 mol) of 1,8-diazabicyclo[5.4.0]-7-undecene (DBU), and 30 mL of dimethyl sulfoxide (DMSO). Subsequently, 1 g (0.014 mol) of propiolic acid (14) was gradually added thereto, followed by reaction at 50° C. for 5 hr. After the completion of the reaction, ethyl acetate was added to the reaction solution. The target product was extracted with a saturated solution of sodium hydrogen carbonate. The extracted aqueous solution was acidified to pH 2 to yield crude crystals. The resulting product was purified by column chromatography to give 3.84 g (yield: 62%) of (E)-3-(4-(4-(di-p-toluylamino)styryl)phenyl)propionic acid [HTM-52] as dark yellow crystals.

This compound was identified as [HTM-52] by nuclear magnetic resonance spectroscopy ($^1$H-NMR).

$^1$H-NMR (300 MHz, DMSO) δ ppm: 2.32 (s, 6H), 6.90 (s, 2H), 7.15-7.18 (m, 10H), 7.43-7.51 (m, 4H), 7.89 (d, 2H), 12.09 (s, 1H)

The metal oxide microparticles according to the present invention are preferably surface-modified with a hole-transporting compound having a structure represented by Formula (1), and is preferably further surface-modified with a coupling agent having a polymerizable reactive group (also referred to as "surface modifier having a polymerizable reactive group"), in addition to the hole-transporting compound. Modification of the surfaces of metal oxide microparticles with a coupling agent having a polymerizable reactive group can further enhance the strength of the surface protective layer, resulting in an increase in wear resistance and an inhibition of image blurring.

(Coupling Agent Having Polymerizable Reactive Group)

The coupling agent having a polymerizable reactive group used for surface modification of the metal oxide microparticles according to the present invention is preferably reactive to, for example, the hydroxy groups present on the surfaces of the metal oxide microparticles. A silane coupling agent having a polymerizable reactive group is preferred for further increasing the hardness of the surface protective layer. The polymerizable reactive group of the silane coupling agent is preferably a radical polymerizable reactive group. The radical polymerizable reactive group also reacts with the crosslinkable polymerizable compound according to the present invention to form a strong protective film. The radical polymerizable reactive group of the silane coupling agent is preferably, for example, a vinyl group, an acryloyl group, or a methacryloyl group. Examples of the silane coupling agent having such a radical polymerizable reactive group include the following known compounds.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{-}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Silane compounds having radical polymerizable reactive organic groups can also be used, in addition to compounds S-1 to S-36. These silane coupling agents may be used alone or in combination of two or more thereof.

(Process of Surface Modification of Metal Oxide Microparticle)

The metal oxide microparticles are preferably surface-modified by dispersion treatment of a hole-transporting compound having a structure represented by Formula (1) in an amount of 0.5 to 10 parts by mass based on 100 parts by mass of the metal oxide microparticles with a wet-media dispersion apparatus. In this range, image memory can be reduced without a reduction in electrical characteristics by the surface protective layer. The dispersion treatment is preferably carried out with a solvent in an amount of 50 to 5000 parts by mass based on 100 parts by mass of the metal oxide microparticles.

In combined use of the hole-transporting compound having a structure represented by Formula (1) with a silane coupling agent having a polymerizable reactive group, the silane coupling agent and the hole-transporting compound may be added at the same time for one-stage surface modification of the metal oxide microparticles. Alternatively, the surface modification may be carried out by two-stage treatment. Preferably, the metal oxide microparticles are surface-modified with the silane coupling agent having a polymerizable reactive group at the first stage, and unreacted hydroxy groups are then modified with the hole-transporting compound represented by Formula (1). In this process, a sufficient amount of the silane coupling agent having a polymerizable reactive group can bind to the surfaces of the metal oxide microparticles, resulting in an enhancement in hole transportability of the surface protective layer.

The amount of the silane coupling agent having a polymerizable reactive group is preferably 0.1 to 100 parts by mass, more preferably 1 to 20 parts by mass, based on 100 parts by mass of the metal oxide microparticles. In this range of the amount of the silane coupling agent, the influence of impurities generated by self-condensation of the silane coupling agent can be reduced to a negligible level, and the wear resistance of the surface protective layer can be effectively enhanced.

The solvent used in the surface modification may be any solvent that can well disperse the metal oxide microparticles and dissolve the hole-transporting compound. Examples thereof include toluene, xylene, methylene chloride, methyl ethyl ketone, cyclohexane, acetone, ethyl acetate, butyl acetate, tetrahydrofuran, 1,4-dioxane, and 1,3-dioxolane.

The wet-media dispersion apparatus used for surface modification in the present invention has a vessel containing beads as media and pulverizes agglomerated metal oxide microparticles and disperses the pulverized microparticles by high-rate rotation of a stirring disk orthogonally attached to the rotating shaft. The apparatus may have any structure that can sufficiently disperse the metal oxide microparticles to be surface-modified and can perform surface modification. Various modes, for example, a vertical or horizontal type and a continuous or batch process, can be employed.

Specifically, a sand mill, an Ultra Visco mill, a pearl mill, a grain mill, a dyno mill, an agitator mill, or a dynamic mill can be used. These dispersion apparatuses conduct pulverization and dispersion by, for example, impact crush, friction, shear, or shearing stress with grinding media, such as balls and beads.

The beads for the sand mill can be balls made of glass, alumina, zircon, zirconia, steel, or flint stone, and preferred are zirconia or zircon beads. Although the beads usually have a diameter of approximately 1 to 2 mm, in the present invention, the diameter is preferably approximately 0.1 to 1.0 mm.

The disk and the inner wall of the vessel of the wet-media dispersion apparatus may be made of various materials, such as stainless steel, nylons, and ceramics. In the present invention, in particular, the disk and the inner wall of the vessel are preferably made of ceramics, such as zirconia or silicon carbide.

A process of surface modification for producing uniform and fine metal oxide microparticles surface-modified with a hole-transporting compound will now be described in detail.

A slurry (suspension of solid particles) containing metal oxide particles, a hole-transporting compound, and optionally a silane coupling agent having a polymerizable reactive group is wet-pulverized for refinement of the metal oxide microparticles and progress of the surface modification of the metal oxide microparticles. The slurry may be wet-pulverized at a temperature of 40° C. to 80° C.

Since the reaction between the hole-transporting compound molecules does not occur even if the surface modification is performed under heating, the reaction with the metal oxide microparticles may be accelerated by heating.

After the completion of the surface modification treatment, removal of the solvent, heat treatment, and then pulverization are performed. Uniform and fine metal oxide microparticles surface-modified with a hole-transporting compound can be thereby prepared. The acidic groups, such as carboxy groups, possessed by the hole-transporting compound molecules probably form ionic bonds with the hydroxy groups on the surfaces of the metal oxide microparticles.

(Particle Size of Metal Oxide Microparticles)

The metal oxide microparticles preferably have a number-average primary particle diameter within a range of 1 to 300 nm and more preferably 3 to 100 nm.

(Process of Measuring of the Number-Average Primary Particle Diameter of Metal Oxide Microparticles)

The number-average primary particle diameter of the metal oxide microparticles can be determined by photographing particles with a scanning electron microscope "JSM-7401F" (manufactured by JEOL Ltd.) at a magnification of 10000, binarizing the photographic images of 300 particles (excluding agglomerates) randomly captured with a scanner using software Ver.1.32 of an automatic image processing analyzer "LUZEX (registered trademark) AP" (manufactured by Nireco Corporation), calculating horizontal Feret's diameter of each particle, and calculating the average of the diameters as the number-average primary particle diameter. The term "horizontal Feret's diameter" refers to the length of a side, parallel to the x-axis, of a bounding rectangle when an image of a metal oxide microparticle is binarized.

<Binder Resin>

Although the binder resin of the surface protective layer may be a polymer having a high hardness, such as polycarbonate and polyarylate, more preferred are resins formed by curing a crosslinkable polymerizable compound.

(Crosslinkable Polymerizable Compound)

The crosslinkable polymerizable compound is preferably a monomer that polymerizes (cures) by irradiation with active energy rays, such as ultraviolet rays and electron beams, into a resin, such as polystyrene or polyacrylate, that is usually used as a binder resin in photoreceptors. In particular, the monomer is preferably a styrenic monomer, acrylic monomer, methacrylic monomer, vinyl toluene monomer, vinyl acetate monomer, or N-vinylpyrrolidone monomer. Among these monomers, radical polymerizable compounds having an acryloyl group ($CH_2{=}CHCO{-}$) or a methacryloyl group ($CH_2{=}CCH_3CO{-}$) are particularly preferred because of their curability with a low light intensity or a short irradiation time.

In the present invention, these crosslinkable polymerizable compounds may be used alone or in combination of two or more thereof.

Examples of the crosslinkable polymerizable compound are shown below. The Ac number and the Mc number refer to the number of acryloyl groups and the number of methacryloyl groups, respectively, in one molecule.

[Chem. 27]

| Example compound No. | Structural Formula | Ac number |
|---|---|---|
| Ac-1 | 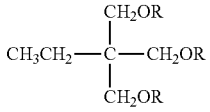 | 3 |
| Ac-2 | 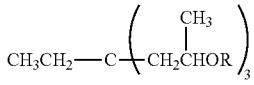 | 3 |
| Ac-3 | 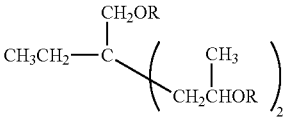 | 3 |
| Ac-4 | 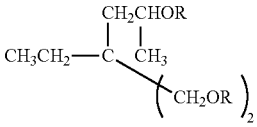 | 3 |
| Ac-5 | 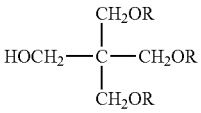 | 3 |
| Ac-6 | 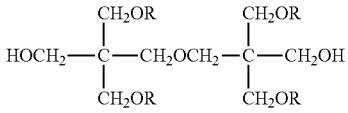 | 4 |

[Chem. 28]

| Example compound No. | Structural Formula | Ac number |
|---|---|---|
| Ac-7 | 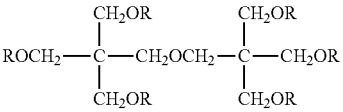 | 6 |
| Ac-8 | 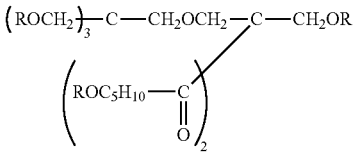 | 6 |

-continued

| Example compound No. | Structural Formula | Ac number |
|---|---|---|
| Ac-9 | 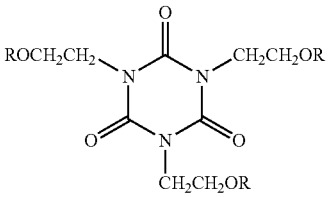 | 3 |
| Ac-10 | $CH_3CH_2C(CH_2OC_3H_6OR)_3$ | 3 |
| Ac-11 | 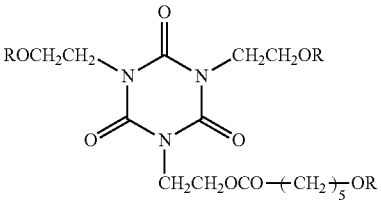 | 3 |

[Chem. 29]

| Example compound No. | Structural Formula | Ac number |
|---|---|---|
| Ac-12 | $(ROCH_2)_3C—O—C(CH_2OR)_3$ | 6 |
| Ac-13 | $(ROCH_2)_3C—CH_2OCH_2—C(H)(CH_2OR)_2$ | 5 |
| Ac-14 | $(ROCH_2)_3C—CH_2OCH_2—C(CH_3)(CH_2OR)_2$ | 5 |
| Ac-15 | $(ROCH_2)_3C—CH_2OCH_2—C(CH_2OH)(CH_2OR)_2$ | 5 |
| Ac-16 | $(ROCH_2)_3C—CH_2OCH_2—C(CH_2OR)(CH_2OH)_2$ | 4 |
| Ac-17 | $(ROCH_2)_3C—O—C(CH_2OH)(CH_2OR)_2$ | 5 |

[Chem. 30]

| Example compound No. | Structural Formula | Ac number |
|---|---|---|
| Ac-18 | 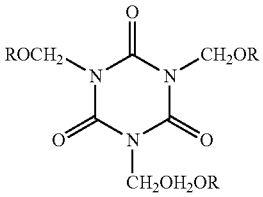 | 3 |
| Ac-19 | $CH_3CH_2C(CH_2CH_2OR)_3$ | 3 |
| Ac-20 | $HOCH_2—C\left(CH_2O—C(=O)CH_2CH_2CH_2CH_2CH_2OR\right)_3$ | 3 |
| Ac-21 | 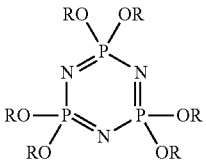 | 6 |
| Ac-22 | 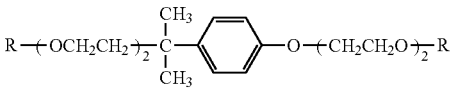 | 2 |
| Ac-23 | 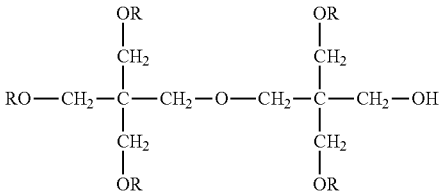 | 5 |

[Chem. 31]
| Example compound No. | Structural Formula | Ac number |
|---|---|---|
| Ac-24 | $R-(OC_2H_4)_n-O-C_6H_4-CH_2-C_6H_4-O-(C_2H_4O)_n-R$ (n ≈ 2) | 2 |
| Ac-25 | 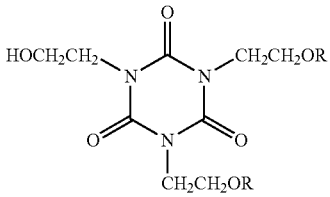 | 2 |
| Ac-26 | $R-(OC_3H_6)_3-OR$ | 2 |
| Ac-27 | $C_{18}H_{37}COOCH_2-C(CH_2OR)_2-CH_2OH$ | 2 |
| Ac-28 | 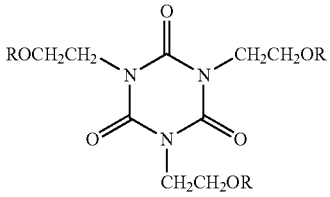 | 3 |
| Ac-29 | $[R-(OC_3H_6)_n-OCH_2]_3CCH_2CH_3$ (n ≈ 3) | 3 |
| Ac-30 | $(CH_3CH_2-C(CH_2OR)_2-CH_2-O)_2$ | 4 |
| Ac-31 | $(ROCH_2)_4-C$ | 4 |
[Chem. 32]
| Example compound No. | Structural Formula | Ac number |
|---|---|---|
| Ac-32 | $RO-C_6H_{12}-OR$ | 2 |
| Ac-33 | $RO-(CH_2CH(CH_3)O)_3-R$ | 2 |
| Ac-34 | $RO-(C_2H_4O)_2-O-C_6H_4-C(CH_3)_2-C_6H_4-(OC_2H_4)_2-OR$ | 2 |

-continued

[Chem. 32]

| Example compound No. | Structural Formula | Ac number |
|---|---|---|
| Ac-35 | 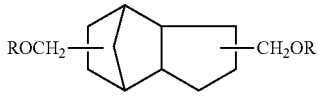 | 2 |
| Ac-36 | $RO-(C_2H_4O)_9-R$ | 2 |
| Ac-37 | $CH_3CH_2-C(CH_2-(OC_2H_4)_l-OR)(CH_2-(OC_2H_4)_m-OR)(CH_2-(OC_2H_4)_n-OR)$ (l + m + n = 3) | 3 |
| Ac-38 | $CH_3CH_2-C(CH_2-(OCOC_6H_{12})_l-OR)(CH_2-(OCOC_6H_{12})_m-OR)(CH_2-(OCOC_6H_{12})_n-OR)$ (l + m + n = 3) | 3 |

[Chem. 33]

| Example compound No. | Structural Formula | Ac number |
|---|---|---|
| Ac-39 | Mixture of | 2 |
| | $RO(CH_2)_2OCONHCH_2-C(CH_3)_2-CH_2CH(CH_3)(CH_2)_2NHCOO(CH_2)_2OR$ | |
| | $RO(CH_2)_2OCONHCH_2CH(CH_3)CH_2-C(CH_3)_2-(CH_2)_2NHCOO(CH_2)_2OR$ | 2 |
| Ac-40 | $(ROCH_2)_3CCH_2OCONH(CH_2)_6NHCOOCH_2C(CH_2OR)_3$ | 6 |
| Ac-41 | $C_2H_5-C(OR)_2-CH_2OCH_2-C(OR)_2-C_2H_5$ | 4 |

where R represents the following formula:

[Chem. 34]

$$R = -C(=O)-C(H)=CH_2$$

[Chem. 35]

| Example compound No. | Structural Formula | Mc number |
|---|---|---|
| Mc-1 | $CH_3CH_2-C(CH_2OR')_3$ | 3 |

-continued

[Chem. 35]

| Example compound No. | Structural Formula | Mc number |
|---|---|---|
| Mc-2 | $CH_3CH_2-C\left(CH_2CH(CH_3)OR'\right)_3$ | 3 |
| Mc-3 | $CH_3CH_2-C(CH_2OR')\left(CH_2CH(CH_3)OR'\right)_2$ | 3 |
| Mc-4 | $CH_3CH_2-C(CH_3)(CH_2CHOR')(CH_2OR')_2$ | 3 |
| Mc-5 | $HOCH_2-C(CH_2OR')_3$ | 3 |
| Mc-6 | $HOCH_2-C(CH_2OR')_2-CH_2OCH_2-C(CH_2OR')_2-CH_2OH$ | 4 |

[Chem. 36]

| Example compound No. | Structural Formula | Mc number |
|---|---|---|
| Mc-7 | $R'OCH_2-C(CH_2OR')_2-CH_2OCH_2-C(CH_2OR')_2-CH_2OR'$ | 6 |
| Mc-8 | $(R'OCH_2)_3C-CH_2OCH_2-C(CH_2OR')\left(R'OC_5H_{10}-C(=O)\right)_2$ | 6 |
| Mc-9 | 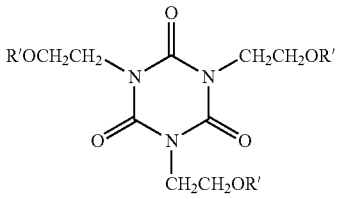 | 3 |

-continued

[Chem. 36]

| Example compound No. | Structural Formula | Mc number |
|---|---|---|
| Mc-10 | $CH_3CH_2C-(CH_2OC_3H_6OR')_3$ | 3 |
| Mc-11 | 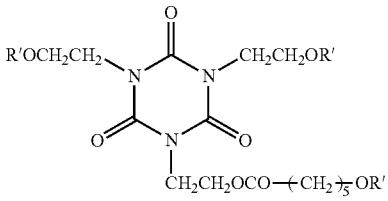 | 3 |

[Chem. 37]

| Example compound No. | Structural Formula | Mc number |
|---|---|---|
| Mc-12 | $(R'OCH_2)_3C-O-C-(CH_2OR')_3$ | 6 |
| Mc-13 | $(R'OCH_2)_3C-CH_2OCH_2-C(H)-(CH_2OR')_2$ | 5 |
| Mc-14 | $(R'OCH_2)_3C-CH_2OCH_2-C(CH_3)-(CH_2OR')_2$ | 5 |
| Mc-15 | $(R'OCH_2)_3C-CH_2OCH_2-C(CH_2OH)-(CH_2OR')_2$ | 5 |
| Mc-16 | $(R'OCH_2)_3C-CH_2OCH_2-C(CH_2OR')-(CH_2OH)_2$ | 4 |
| Mc-17 | $(R'OCH_2)_3C-O-C(CH_2OH)-(CH_2OR')_2$ | 5 |

[Chem. 38]
| Example compound No. | Structural Formula | Mc number |
|---|---|---|
| Mc-18 | 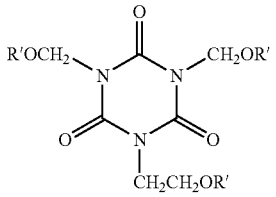 | 3 |
| Mc-19 | $CH_3CH_2C{-}(CH_2CH_2OR')_3$ | 3 |
| Mc-20 | $HOCH_2{-}C\left(CH_2O{-}\underset{\underset{O}{\parallel}}{C}CH_2CH_2CH_2CH_2CH_2OR'\right)_3$ | 3 |
| Mc-21 | 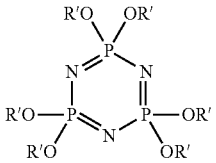 | 6 |
| Mc-22 | 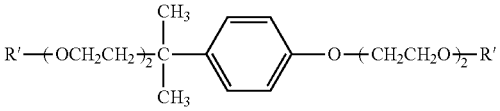 | 2 |
| Mc-23 | 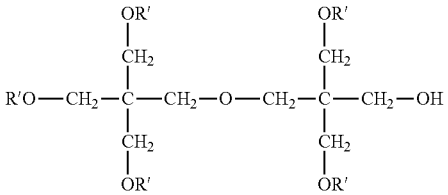 | 5 |
[Chem. 39]
| Example compound No. | Structural Formula | Mc number |
|---|---|---|
| Mc-24 | 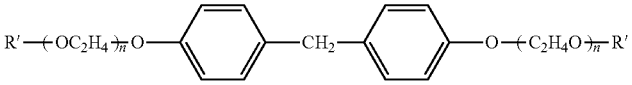 (n ≈ 2) | 2 |
| Mc-25 | 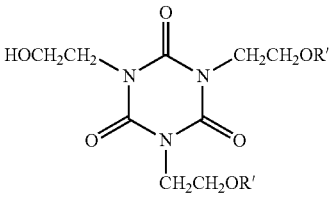 | 2 |
| Mc-26 | $R'{-}(OC_3H_6)_3{-}OR'$ | 2 |

-continued
[Chem. 39]
| Example compound No. | Structural Formula | Mc number |
|---|---|---|
| Mc-27 | $C_{18}H_{37}COOCH_2-C(CH_2OR')_2-CH_2OH$ | 2 |
| Mc-28 | 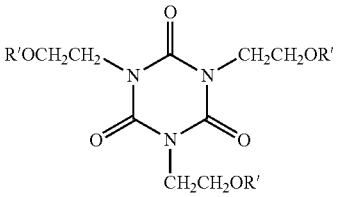 | 3 |
| Mc-29 | $[R'-(OC_3H_6)_n OCH_2)_3 CCH_2CH_3$ (n ≈ 3) | 3 |
| Mc-30 | $(CH_3CH_2-C(CH_2OR')_2-CH_2-O)_2$ | 4 |
| Mc-31 | $(R'OCH_2)_4-C$ | 4 |
[Chem. 40]
| Example compound No. | Structural Formula | Mc number |
|---|---|---|
| Mc-32 | $R'O-C_6H_{12}-OR'$ | 2 |
| Mc-33 | $R'O-(CH_2CH(CH_3)O)_3-R'$ | 2 |
| Mc-34 | 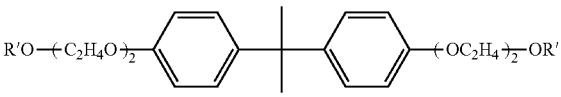 | 2 |
| Mc-35 | 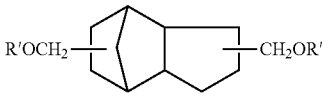 | 2 |
| Mc-36 | $R'O-(C_2H_4O)_9-R'$ | 2 |
| Mc-37 | $CH_3CH_2-C(CH_2-(OC_2H_4)_l-OR')(CH_2-(OC_2H_4)_m-OR')(CH_2-(OC_2H_4)_n-OR')$ (l + m + n = 3) | 3 |

-continued

[Chem. 40]

| Example compound No. | Structural Formula | Mc number |
|---|---|---|
| Mc-38 | $CH_3CH_2-C(CH_2-(OCOC_6H_{12})_m-OR')_3$ (l + m + n = 3) | 3 |

[Chem. 41]

| Example compound No. | Structural Formula | Mc number |
|---|---|---|
| Mc-39 | Mixture of | 2 |
| | $R'O(CH_2)_2OCONHCH_2-C(CH_3)_2-CH_2CH(CH_3)(CH_2)_2NHCOO(CH_2)_2OR'$ | |
| | $R'O(CH_2)_2ICINHCH_2CH(CH_3)CH_2-C(CH_3)_2-(CH_2)_2NHCOO(CH_2)_2OR'$ | 2 |
| Mc-40 | $(R'OCH_2)_3CCH_2OCONH(CH_2)_6NHCOCH_2C(CH_2OR')_3$ | 6 |
| Mc-41 | $C_2H_5-C(OR')_2-CH_2OCH_2-C(OR')_2-C_2H_5$ | 4 |

where R' represents the following formula:

[Chem. 42]

$$R' = -C(=O)-C(CH_3)=CH_2$$

In the present invention, the crosslinkable polymerizable compound preferably has three or more functional groups (reactive groups). Two or more polymerizable compounds may be used in combination. Even in such a case, it is preferred that the polymerizable compounds are composed of at least 50 mass % of a compound having three or more functional groups. These crosslinkable polymerizable compounds also react to a coupling agent having a polymerizable reactive group and form strong coating films, which allows formation of a surface protective layer having excellent wear resistance.

The amount of the metal oxide microparticles surface-modified with a hole-transporting compound having a structure represented by Formula (1) is preferably within a range of 50 to 200 parts by mass, more preferably 60 to 120 parts by mass, based on 100 parts by mass of the binder resin or the crosslinkable polymerizable compound. Within this range, the surface protective layer can be strong and have high wear resistance. In addition, since a sufficient hole transportability is achieved, the electrophotographic characteristics are not deteriorated.

(Other Additives)

The surface protective layer according to the present invention can further contain various types of charge-transporting materials, antioxidants, and lubricant particles. The lubricant particles can be, for example, fluorine-containing resin particles. The fluorine-containing resin particles are preferably made of one or more material selected from ethylene tetrafluoride resins, ethylene trifluoride chloride resins, ethylene propylene trifluoride chloride resins, vinyl fluoride resins, vinylidene fluoride resins, ethylene difluoride dichloride resins, and copolymers thereof. In particular, ethylene tetrafluoride resins and vinylidene fluoride resins are preferred. The amount of the lubricant particles in the surface protective layer is preferably 5 to 70 parts by mass, more preferably 10 to 60 parts by mass, based on 100 parts by mass of the binder resin. The lubricant particles preferably have a number-average primary particle diameter of 0.01 to 1 μm and most preferably 0.05 to 0.5 μm. The resin may have any molecular weight which can be appropriately selected.

<Formation of Surface Protective Layer>

The surface protective layer can be produced by preparing a coating solution containing a binder resin, metal oxide microparticles, and optional lubricant particles and other components, applying the coating solution onto the surface of the photosensitive layer by a known method, and drying and curing the resulting coating film through air drying or thermal drying. If the binder resin is the crosslinkable polymerizable compound, the coating solution preferably contains a polymerization initiator described below. The surface protective layer preferably has a thickness of 0.2 to 10 μm and more preferably 0.5 to 6 μm.

(Solvent)

Examples of the solvent used in formation of the surface protective layer include, but not limited to, methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, and diethylamine.

(Polymerization Initiator)

The crosslinkable polymerizable compound usable as the binder resin of the surface protective layer according to the present invention can be polymerized by a method that uses an electron beam for cleavage or by a method that uses light or heat under the presence of a radical polymerization initiator. The radical polymerization initiator may be either a photopolymerization initiator or a thermal polymerization initiator. Also, both initiators may be used in combination.

Examples of the thermal polymerization initiator used in formation of the surface protective layer according to the present invention include azo compounds, such as 2,2'-azobisisobutyronitrile, 2,2'-azobis(2,4-dimethylazobisvaleronitrile), and 2,2'-azobis(2-methylbutyronitrile); and peroxides, such as benzoyl peroxide (BPO), di-tert-butylhydroperoxide, tert-butylhydroperoxide, chlorobenzoyl peroxide, dichlorobenzoyl peroxide, bromomethylbenzoyl peroxide, and lauroyl peroxide.

Examples of the photopolymerization initiator include acetophenone-based or ketal-based photopolymerization initiators, such as diethoxyacetophenone, 2,2-dimethoxy-1,2-diphenylethan-1-one, 1-hydroxy-cyclohexyl-phenylketone, 4-(2-hydroxyethoxyl)phenyl(2-hydroxy-2-propyl)ketone, 2-benzyl-2-dimethylamino-1-(4-morpholinophenyl) butanone-1 (Irgacure 369: manufactured by BASF Japan Ltd.), 2-hydroxy-2-methyl-1-phenylpropan-1-one, 2-methyl-2-morpholino(4-methylthiophenyl)propan-1-one, and 1-phenyl-1,2-propanedione-2-(o-ethoxycarbonyl)oxime; benzoin ether-based photopolymerization initiators, such as benzoin, benzoin methyl ether, benzoin ethyl ether, benzoin isobutyl ether, and benzoin isopropyl ether; benzophenone-based photopolymerization initiators, such as benzophenone, 4-hydroxybenzophenone, methyl o-benzoylbenzoate, 2-benzoylnaphthalene, 4-benzoylbiphenyl, 4-benzoylphenyl ether, acrylated benzophenone, and 1,4-benzoylbenzene; and thioxanthone-based photopolymerization initiators, such as 2-isopropylthioxanthone, 2-chlorothioxanthone, 2,4-dimethylthioxanthone, 2,4-diethylthioxanthone, and 2,4-dichlorothioxanthone.

Other examples of the photopolymerization initiator include ethylanthraquinone, 2,4,6-trimethylbenzoyl diphenylphosphine oxide, 2,4,6-trimethylbenzoyl phenylethoxyphosphine oxide, bis(2,4,6-trimethylbenzoyl)phenylphosphine oxide (Irgacure 819: manufactured by BASF Japan Ltd.), bis(2,4-dimethoxybenzoyl)-2,4,4-trimethylpentylphosphine oxide, methylphenylglyoxy ester, 9,10-phenanthrene, acridine compounds, triazine compounds, and imidazole compounds. Alternatively, compounds having an effect of accelerating photopolymerization may be used alone or in combination with the above-mentioned photopolymerization initiator. Examples of such compounds include triethanolamine, methyldiethanolamine, ethyl 4-dimethylaminobenzoate, isoamyl 4-dimethylaminobenzoate, benzoic acid 2-(dimethylamino)ethyl benzoate, and 4,4'-dimethylaminobenzophenone.

The polymerization initiator used in formation of the surface protective layer according to the present invention is preferably a photopolymerization initiator, more preferably an alkylphenone compound or a phosphine oxide compound, and most preferably an initiator having an α-hydroxyacetophenone structure or an acylphosphine oxide structure.

These polymerization initiators may be used alone or in combination of two or more thereof. The amount of the polymerization initiator is 0.1 to 20 parts by mass, preferably 0.5 to 10 parts by mass, based on 100 parts by mass of the crosslinkable polymerizable compound.

(Curing Process of Surface Protective Layer)

In the present invention, polymerization for forming the surface protective layer is preferably performed by irradiating the coating film with active energy rays to generate radicals and to cause polymerization and forming crosslinking bonds through intermolecular and intramolecular crosslinking reaction to generate a cured resin. The active energy rays are preferably ultraviolet rays, light such as visible light, or electron beams. Ultraviolet rays are most preferred because of its ease of use.

The ultraviolet ray source may be of any type that can generate ultraviolet rays. For example, a low-pressure mercury lamp, medium-pressure mercury lamp, high-pressure mercury lamp, ultrahigh-pressure mercury lamp, carbon arc lamp, metal halide lamp, xenon lamp, flash (pulse) xenon lamp, or ultraviolet LED lamp can be used. The irradiation conditions vary depending on the lamp used. The dose of the active energy rays is usually 1 to 20 $mJ/cm^2$ and preferably 5 to 15 $mJ/cm^2$. The output voltage of the light source is preferably 0.1 to 5 kW and more preferably 0.5 to 3 kW.

The electron beam source may be any electron beam processing system, and effectively used is a curtain beam system, which is generally used as an electron beam accelerator for electron beam irradiation, is relatively inexpensive, and can generate high-power beams. The accelerating voltage in electron beam irradiation is preferably 100 to 300 kV. The absorbed dose is preferably 0.005 Gy to 100 kGy (0.5 rad to 10 Mrad).

The irradiation time required for achievement of a dose of active energy rays is preferably 0.1 sec to 10 min and more preferably 1 sec to 5 min from the viewpoint of polymerization efficiency or working efficiency.

In the present invention, the surface protective layer can be dried before, during, and after the irradiation of active energy rays. The timing of the drying process can be appropriately selected in combination with conditions of irradiation with active energy rays. The conditions of drying the surface protective layer can be appropriately selected based on, for example, the type of solvent used in the coating solution and the thickness of the surface protective layer. The drying temperature preferably ranges from room temperature to 180° C. and most preferably from 80° C. to 140° C. The drying period of time preferably ranges from 1 to 200 min and most preferably from 5 to 100 min. In the present invention, the amount of the solvent contained in the surface protective layer can be controlled within a range of 20 to 75 ppm by drying the surface protective layer under the above-described drying conditions.

The surface protective layer disposed on the photosensitive layer as described above can increase the hardness of the surface of the photoreceptor and enhance the wear resistance and durability.

The constituent materials, other than the surface protective layer, constituting the photoreceptor of the present invention will now be described.

<<Electroconductive Support>>

The support used in the present invention may be any electroconductive support. Examples thereof include drums and sheets of metals, such as aluminum, copper, chromium, nickel, zinc, and stainless steel; plastic films laminated with metal foil such as aluminum foil and copper foil; plastic films covered with metal deposited films of aluminum, indium oxide, and tin oxide films; and metals, plastic films, and paper covered with electroconductive layers by application of electroconductive materials alone or in combination with binder resins.

<<Intermediate Layer>>

In the present invention, an intermediate layer having a barrier function and an adhesive function may be disposed between the electroconductive support and the photosensitive layer.

The intermediate layer can be formed by immersion coating in a solution prepared by dissolving a binder resin, such as casein, poly(vinyl alcohol), nitrocellulose, ethylene-acrylic acid copolymer, polyamide, polyurethane, or gelatin, in a known solvent. In particular, polyamide resins dissolvable in alcohol are preferred.

The intermediate layer can contain inorganic microparticles, such as various metal oxide microparticles, for controlling the resistance. Examples of the inorganic microparticles include microparticles of metal oxides, such as alumina, zinc oxide, titanium oxide, tin oxide, antimony oxide, indium oxide, and bismuth oxide; and ultrafine particles of tin-doped indium oxide, antimony-doped tin oxide, and zirconium oxide.

These inorganic microparticles may be used alone or in a combination. A mixture of two or more different microparticles may be present in the form of solid solution or fusion. The inorganic microparticles preferably have an average particle diameter of 0.3 μm or less and more preferably 0.1 μm or less.

The solvent used for formation of the intermediate layer is preferably a solvent that can well disperse inorganic microparticles, such as metal oxide microparticles, and can dissolve polyamide resins. Specifically, preferred are alcohols having 2 to 4 carbon atoms, such as ethanol, n-propyl alcohol, isopropyl alcohol, n-butanol, t-butanol, and sec-butanol, which can highly dissolve polyamide resins and have excellent coating performance. In addition, an auxiliary solvent that is used together with the above-mentioned solvent and provides an advantageous effect may be used for improving the storage stability and dispersion of the microparticles. Examples of the auxiliary solvent include methanol, benzyl alcohol, toluene, methylene chloride, cyclohexanone, and tetrahydrofuran.

The concentration of the binder resin solution is appropriately determined depending on the thickness of the intermediate layer and the production rate.

When the inorganic microparticles are dispersed, the amount of the inorganic microparticles is preferably 20 to 400 parts by mass, more preferably 50 to 200 parts by mass, based on 100 parts by mass of the binder resin.

The inorganic microparticles can be dispersed by any process, for example, a process using an ultrasonic disperser, a ball mill, a sand grinder, or a homomixer.

The applied coating film as the intermediate layer can be dried by an appropriate process selected depending on the type of the solvent and the thickness of the layer, and thermal drying is preferred.

The intermediate layer preferably has a thickness of 0.1 to 15 μm and more preferably 0.3 to 10 μm.

<<Charge-Generating Layer>>

The charge-generating layer in the present invention contains a charge-generating material and a binder resin and is preferably formed by application of a dispersion of the charge-generating material in a solution of the binder resin.

The charge-generating material may be a known one. Examples thereof include, but not limited to, azo materials, such as Sudan red and Diane blue; quinone pigments, such as pyrene quinone and anthanthrone; quinocyanine pigments; perylene pigments; indigo pigments, such as indigo and thioindigo; and phthalocyanine pigments. These charge-generating materials may be used alone or in the form of dispersion in a known resin.

The binder resin contained in the charge-generating layer may be a known resin. Examples thereof include, but not limited to, polystyrene resins, polyethylene resins, polypropylene resins, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymer resins containing two or more of these resins (e.g., vinyl chloride-vinyl acetate copolymer resins, vinyl chloride-vinyl acetate-maleic anhydride copolymer resins); and polyvinyl carbazole resins.

The charge-generating layer is preferably formed by dissolving a binder resin in a solvent, dispersing charge-generating materials in the solution with a disperser to prepare a coating solution, applying the coating solution with an applicator at a predetermined thickness, and drying the coating film.

Examples of the solvent for dissolving and applying the binder resin used for formation of the charge-generating layer include, but not limited to, toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1-dioxane, 1,3-dioxolane, pyridine, and diethylamine.

The charge-generating material can be dispersed by any process, for example, a process using an ultrasonic disperser, a ball mill, a sand grinder, or a homomixer.

The amount of the charge-generating material is preferably 1 to 600 parts by mass, more preferably 50 to 500 parts by mass, based on 100 parts by mass of the binder resin. The thickness of the charge-generating layer varies depending on, for example, the characteristics of the charge-generating material, the characteristics of the binder resin, and the mixture ratio thereof, and is preferably 0.01 to 5 μm and more preferably 0.05 to 3 μm. Filtration of the charge-generating layer coating solution to remove foreign substances and agglomerates before the application can prevent occurrence of image defects. The charge-generating layer can also be formed by vacuum deposition of the pigment.

<<Charge-Transporting Layer>>

The charge-transporting layer of the photoreceptor of the present invention contains a charge-transporting material (CTM) and a binder resin and is formed by application of a binder resin solution containing the charge-transporting material.

In the present invention, any charge-transporting material may be contained in the charge-transporting layer as long as the ionization potential ($IP_A$) of the charge-transporting material contained in the charge-transporting layer and the ionization potential ($IP_B$) of the metal oxide microparticle contained in the surface protective layer satisfy the relationship represented by Expression (A). The charge-transporting material can be a known charge-transporting material. Examples thereof include carbazole derivatives, oxazole derivatives, oxadiazole derivatives, triazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline compounds, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazole, poly-1-vinylpyrene, poly-9-vinylanthracene, and triphenylamine derivatives. Among them, preferred are carbazole derivatives, triarylamine derivatives, and stilbene derivatives. These materials may be used in combination of two or more thereof.

In the present invention, in order to control the ionization potentials to satisfy the relationship represented by Expression (A), the charge-transporting material contained in the charge-transporting layer preferably has an ionization potential ($IP_A$) within a range of $5.3\ eV \leq IP_A \leq 5.7\ eV$. Examples of such charge-transporting materials are shown below.

[Chem. 43]

| Charge-transporting material No. | Structure | $IP_A$(eV) |
|---|---|---|
| CTM-1 | 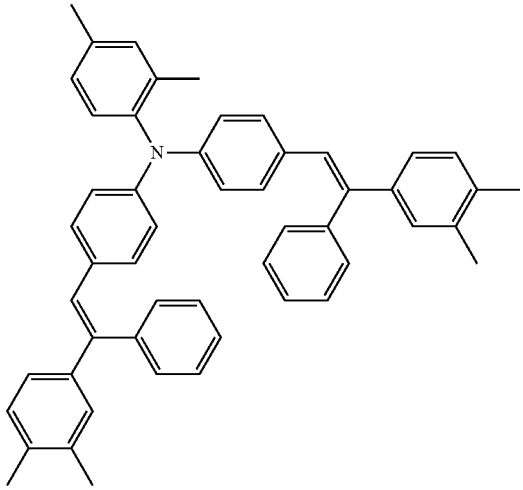 | 5.42 |
| CTM-2 | 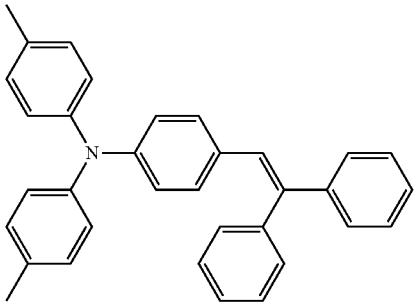 | 5.62 |
| CTM-3 | 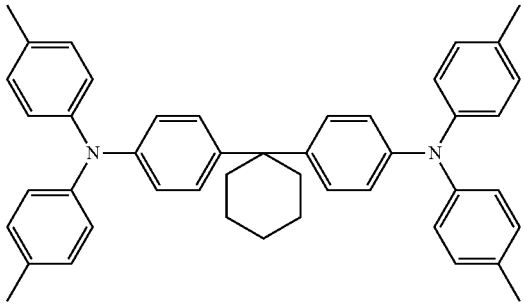 | 5.48 |

-continued
[Chem. 43]
| Charge-transporting material No. | Structure | $IP_A$(eV) |
|---|---|---|
| CTM-4 | 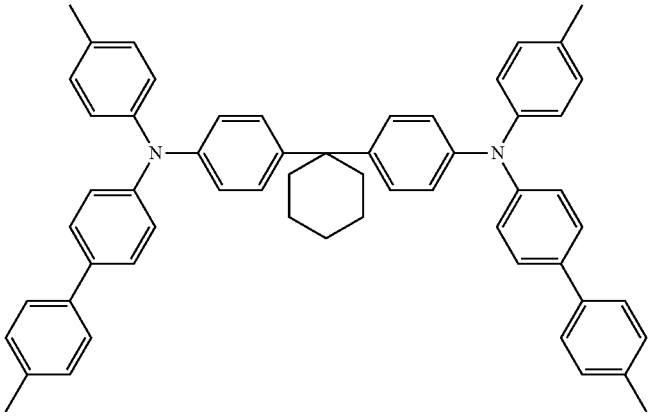 | 5.62 |
25
[Chem. 44]
| Charge-transporting material No. | Structure | $IP_A$(eV) |
|---|---|---|
| CTM-5 | 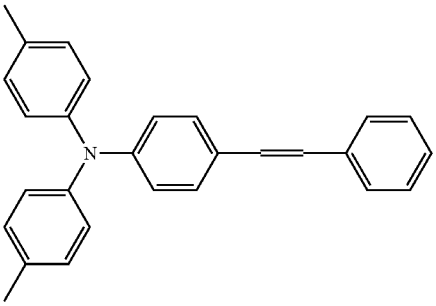 | 5.50 |
| CTM-6 | 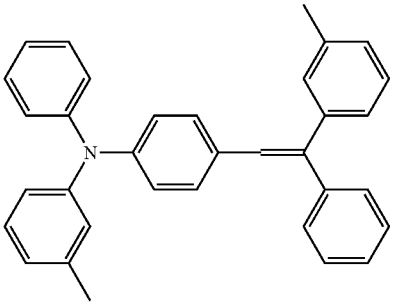 | 5.45 |

-continued
[Chem. 44]
| Charge-transporting material No. | Structure | $IP_A$(eV) |
|---|---|---|
| CTM-7 | 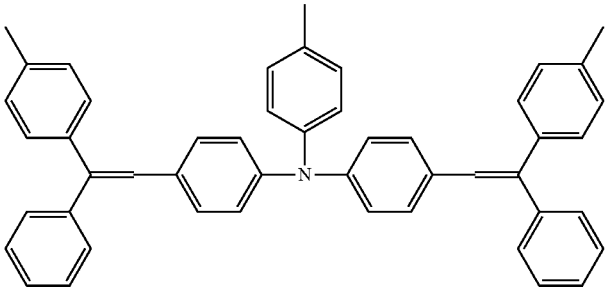 | 5.40 |
20
[Chem. 45]
| Charge-transporting material No. | Structure | $IP_A$(eV) |
|---|---|---|
| CTM-8 | 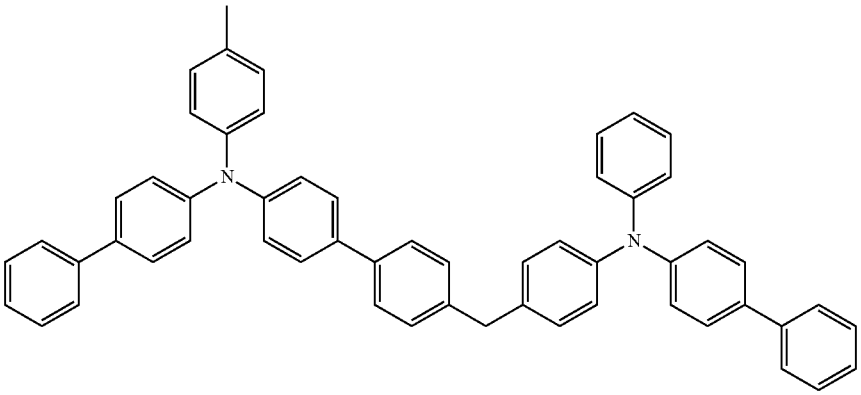 | 5.40 |
| CTM-9 | 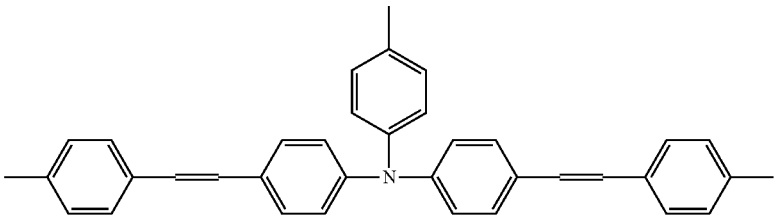 | 5.30 |
| CTM-10 | 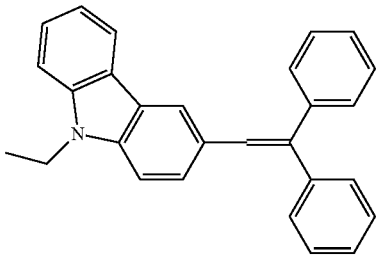 | 5.65 |

-continued
[Chem. 45]
| Charge-transporting material No. | Structure | $IP_A$(eV) |
|---|---|---|
| CTM-11 | 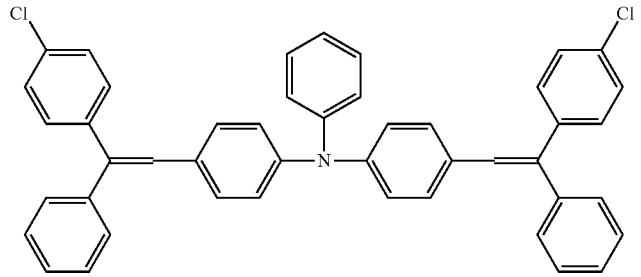 | 5.65 |
| CTM-12 | 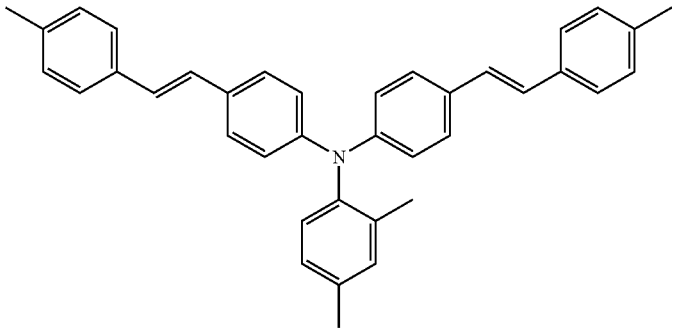 | 5.36 |
[Chem. 46]
| Charge-transporting material No. | Structure | $IP_A$(eV) |
|---|---|---|
| CTM-13 | 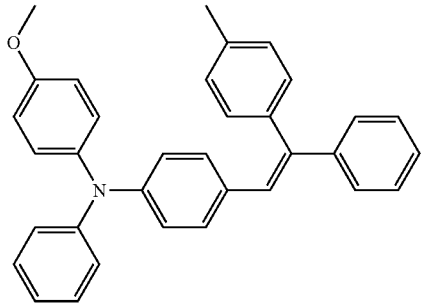 | 5.42 |

-continued
[Chem. 46]
| Charge-transporting material No. | Structure | $IP_A$(eV) |
|---|---|---|
| CTM-14 | 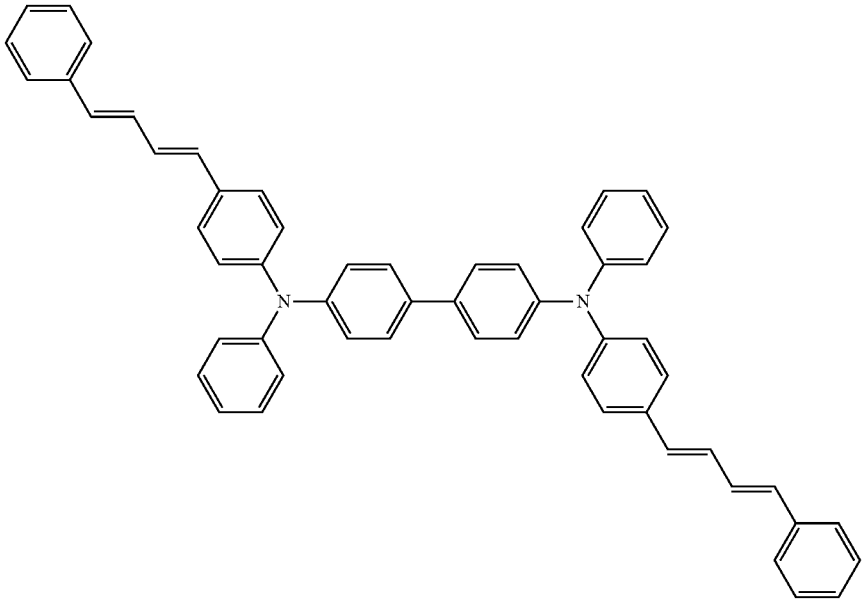 | 5.43 |
| CTM-15 | 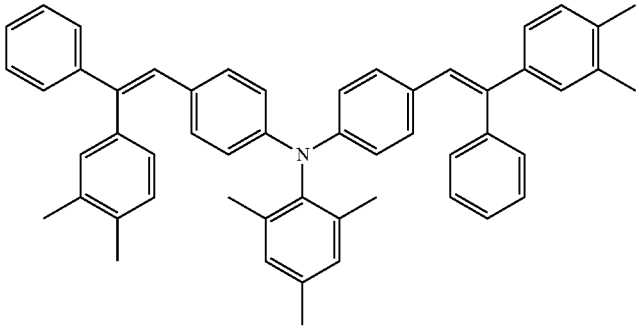 | 5.40 |
[Chem. 47]
| Charge-transporting material No. | Structure | $IP_A$(eV) |
|---|---|---|
| CTM-16 | 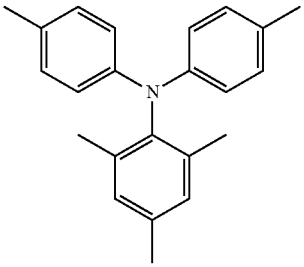 | 5.31 |

-continued

[Chem. 47]

| Charge-transporting material No. | Structure | $IP_A$(eV) |
|---|---|---|
| CTM-17 | 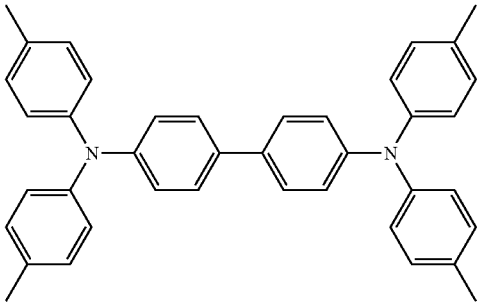 | 5.48 |
| CTM-18 | 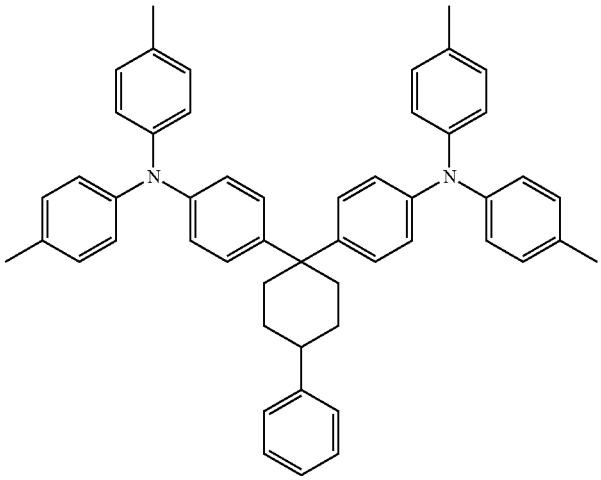 | 5.55 |

(Binder Resin)

The binder resin for the charge-transporting layer may be any known resin. Examples thereof include polycarbonate, polyacrylate, polyester, polystyrene, styrene-acrylnitrile copolymer, polymethacrylic acid ester, and styrene-methacrylic acid ester copolymer resins. Preferred is polycarbonate. From the points of view of crack resistance, wear resistance, and chargeability, for example, BPA, BPZ, dimethyl BPA, and BPA-dimethyl BPA copolymers are preferred.

The charge-transporting layer is preferably formed by application of a coating solution containing a binder resin and a charge-transporting material at a predetermined thickness with an applicator, and drying the coating film.

Examples of the solvent for dissolving the binder resin and the charge-transporting material include, but not limited to, toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine.

The amount of the charge-transporting material is preferably 10 to 500 parts by mass, more preferably 20 to 100 parts by mass, based on the 100 parts by mass of the binder resin.

The thickness of the charge-transporting layer varies in the range of preferably 5 to 40 μm, more preferably 10 to 30 μm, although it depending on, for example, the characteristics of the charge-transporting material and the binder resin and the mixture ratio thereof.

The charge-transporting layer may contain an antioxidant, an electronic conductive agent, a stabilizer, and other agents. Preferred examples of the antioxidant are those described in Japanese Patent Laid-Open No. 2000-305291. Preferred examples of the electronic conductive agent are those described in Japanese Patent Laid-Open Nos. S50-137543 and S58-76483.

<<Application Process in Formation of Photoreceptor>>

The individual layers of the photoreceptor of the present invention, e.g., the intermediate layer, the charge-generating layer, the charge-transporting layer, and the surface protective layer, can be formed by a known application process, such as immersion coating, spray coating, spinner coating, bead coating, blade coating, beam coating, or circular amount regulating coating (circular slide hopper coating). The circular amount regulating coating is described in, for example, Japanese Patent Laid-Open Nos. S58-189061 and 2005-275373.

<<Electrophotographic Imaging Apparatus>>

Figure 2:
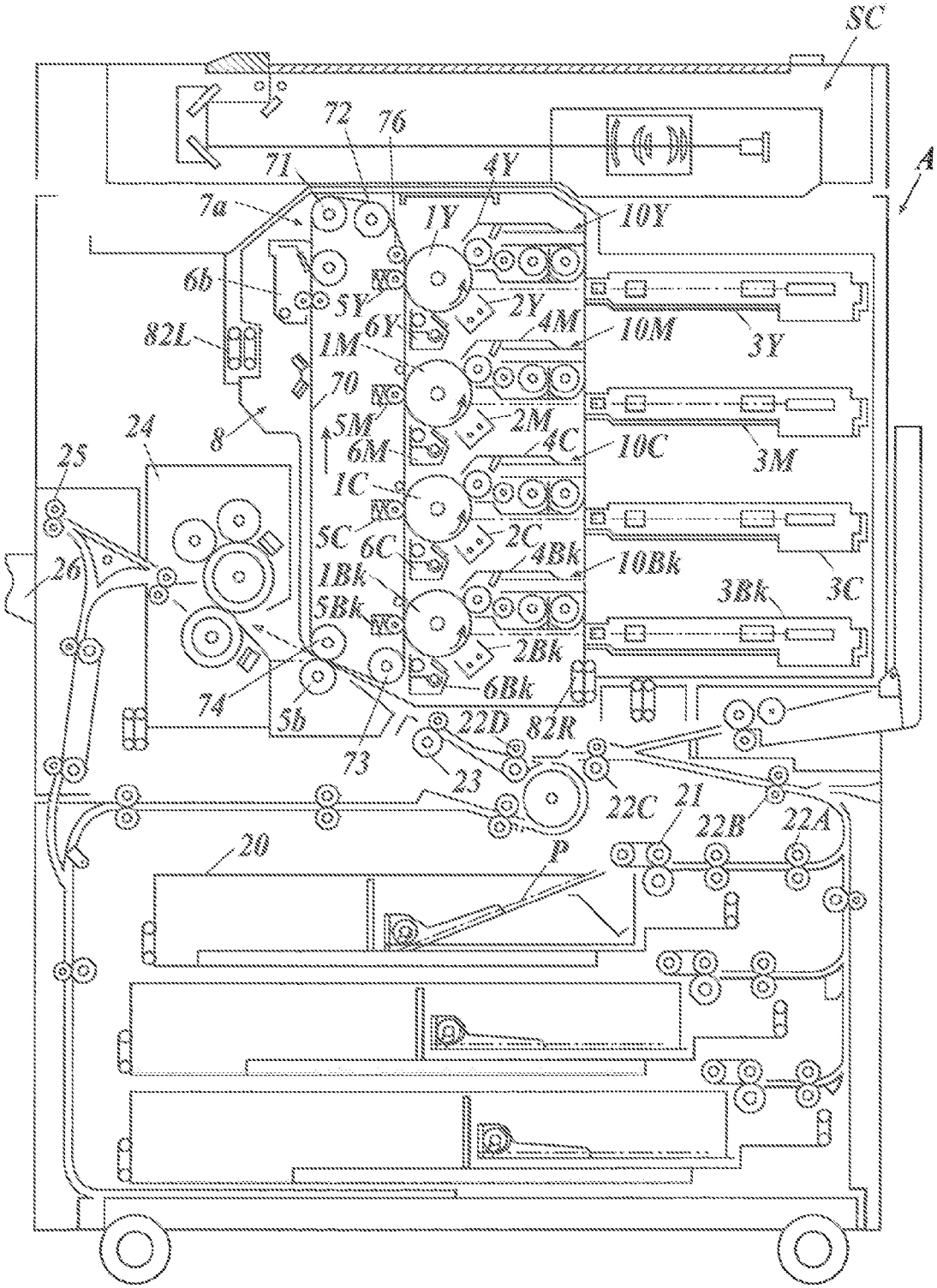
FIG. 2 is a cross-sectional view of a structure of a full-color electrophotographic imaging apparatus according to an embodiment of the present invention.

An electrophotographic imaging apparatus including the organic photoreceptor of the present invention will now be described. FIG. 2 is a cross-sectional view of a structure of a full-color electrophotographic imaging apparatus according to an embodiment of the present invention.

This color electrophotographic imaging apparatus is of a tandem type and is composed of four image-forming portions (also referred to "image-forming units") 10Y, 10M, 10C, and 10Bk; an endless-belt intermediate transfer unit 7*a*; a fed paper conveying means 21; and a fixing means 24. An original image scanner SC is disposed at an upper portion of the main body A of the imaging apparatus.

The image-forming unit 10Y forming yellow images includes a photoreceptor drum 1Y serving as a first image carrier, a charging means (charging step) 2Y disposed in the periphery of the photoreceptor drum 1Y, an exposure means (exposure step) 3Y, a developing means (developing step) 4Y, and a primary transfer means (primary transfer step) composed of a primary transfer roller 5Y and a cleaning means 6Y. The image-forming unit 10M forming magenta images includes a photoreceptor drum 1M serving as a first image carrier, a charging means 2M, an exposure means 3M, a developing means 4M, and a primary transfer means composed of a primary transfer roller 5M and a cleaning means 6M. The image-forming unit 10C forming cyan images includes a photoreceptor drum 1C serving as a first image carrier, a charging means 2C, an exposure means 3C, a developing means 4C, and a primary transfer means composed of a primary transfer roller 5C and a cleaning means 6C. The image-forming unit 10Bk forming black images includes a photoreceptor drum 1Bk serving as a first image carrier, a charging means 2Bk, an exposure means 3Bk, a developing means 4Bk, and a primary transfer means composed of a primary transfer roller 5Bk and a cleaning means 6Bk.

The four image-forming units (10Y, 10M, 10C, and 10Bk, respectively) include the photoreceptors (1Y, 1M, 1C, and 1Bk) at the center, the charging means (2Y, 2M, 2C, and 2Bk), the exposure means (3Y, 3M, 3C, and 3Bk), the developing means (4Y, 4M, 4C, and 4Bk), and the cleaning means (6Y, 6M, 6C, and 6Bk) for cleaning the photoreceptor (1Y, 1M, 1C, and 1Bk).

The image-forming units 10Y, 10M, 10C, and 10Bk have the same structure except that the photoreceptor 1Y, 1M, 1C, and 1Bk form toner images of different colors. The image-forming unit 10Y will, accordingly, be described in detail as an example.

The image-forming unit 10Y includes the charging means 2Y (hereinafter, also referred to as charger 2Y), the exposure means 3Y, the developing means 4Y, and the cleaning means 6Y disposed in the periphery of the photoreceptor 1Y serving as an image forming body, and forms a yellow (Y) toner image on the photoreceptor 1Y. In the image-forming unit 10Y of this embodiment, at least the photoreceptor 1Y, the charging means 2Y, the developing means 4Y, and the cleaning means 6Y are integrated into a module.

The charging means 2Y applies a uniform potential to the photoreceptor 1Y. In this embodiment, a corona charger 2Y is used for the photoreceptor 1Y.

The image exposure means 3Y exposes the photoreceptor 1Y charged with a uniform potential by the charger 2Y based on image signals (yellow image) to form an electrostatic latent image corresponding to the yellow image. This exposure means 3Y is, for example, composed of LEDs disposed such that light-emitting elements are arrayed along the axis of the photoreceptor 1Y and image-forming elements (trade name: Selfoc (registered trademark) lens), or is a laser optical system.

The endless-belt intermediate transfer unit 7*a* includes a semiconductive endless-belt intermediate transfer body 70 that is wound and turnably supported by a plurality of rollers and serves as a second image carrier.

Images of the respective colors formed by the image-forming units 10Y, 10M, 10C, and 10Bk are successively transferred on the endless-belt intermediate transfer body 70 rotated by the primary transfer means, primary transfer rollers 5Y, 5M, 5C, and 5Bk, to form a combined color image. The transfer material P (a support supporting the fixed final image: e.g., plain paper or a transparent sheet) accommodated in a sheet-feeding cassette 20 is supplied by a sheet-feeding means 21 and is conveyed to the secondary transfer means, a secondary transfer roller 5*b*, through a plurality of intermediate rollers 22A, 22B, 22C, and 22D and a resist roller 23. The images of the respective colors are collectively transferred on the transfer material P by secondary transfer. The color image transferred to the transfer material P is fixed by a fixing means 24. The transfer material P is pinched with paper discharge rollers 25 and is placed on a paper discharge tray 26 outside the apparatus. Herein, the transfer supports for toner images formed on the photoreceptor, such as the intermediate transfer body and the transfer material, are collectively referred to as a transfer medium.

Meanwhile, the color image is transferred to the transfer material P by the secondary transfer roller 5*b*, which is the secondary transfer means. The transfer material P is separated from the endless-belt intermediate transfer body 70 curvedly, and the residual toner of the body 70 is removed by the cleaning means 6*b*.

The primary transfer roller 5Bk is always in contact with the photoreceptor 1Bk all the time during the image forming process. Other primary transfer rollers 5Y, 5M, and 5C come into contact with the photoreceptor 1Y, 1M, and 1C, respectively, only during the formation of the color image.

The secondary transfer roller 5*b* comes into contact with the endless-belt intermediate transfer body 70 only during the passing of the transfer material P for secondary transfer.

The housing 8 is drawable from the apparatus main body A through supporting rails 82L and 82R.

The housing 8 is composed of the image-forming units 10Y, 10M, 10C, and 10Bk and the endless-belt intermediate transfer unit 7*a*.

The image-forming units 10Y, 10M, 10C, and 10Bk are disposed in the vertical direction. The endless-belt intermediate transfer unit 7*a* is disposed on the left of the photoreceptors 1Y, 1M, 1C, and 1Bk in the drawing. The endless-belt intermediate transfer unit 7*a* is composed of the turnable endless-belt intermediate transfer body 70 moving around the rollers 71, 72, 76, 73, and 74, the primary transfer rollers 5Y, 5M, 5C, and 5Bk, and the cleaning means 6*b*.

Examples

The present invention will now be specifically described by examples, which should not be intended to limit the present invention. It is noted that "part(s)" and "%" in examples indicate "part(s) by mass" and "% by mass", respectively, unless defined otherwise.

<<Production of Photoreceptor>>

Surface-modified metal oxide microparticles were produced as follows.

<Production of Surface-Modified Metal Oxide Microparticles [1]>

Metal oxide microparticles (100 parts by mass of "tin oxide" having a number-average primary particle diameter of 20 nm), a coupling agent having a polymerizable reactive group (7.0 parts by mass of "3-methacryloxypropyltrimethoxysilane (S-15: manufactured by Gelest, Inc.)", a hole-transporting compound "HTM-1" represented by Formula (1) (1.5 parts by mass), and methyl ethyl ketone (1000 parts by mass) were mixed in a wet sand mill (containing 0.5 mm diameter alumina beads) at 30° C. and a rotation rate of 1000 rpm for 1 hour. The alumina beads were then removed by filtration. The tin oxide microparticles were separated from methyl ethyl ketone and were dried at 80° C. to obtain the tin oxide microparticles surface-modified with the coupling agent having a polymerizable reactive group (S-15) and the hole-transporting compound "HTM-1", surface-modified metal oxide microparticles [1].

This "surface-modified metal oxide microparticle [1]" had an ionization potential ($IP_B$) of 5.76 eV, measured with a photoelectron spectrometer in air "AC-3" (manufactured by Riken Keiki Co., Ltd.) as described above.

<Production of Surface-Modified Metal Oxide Microparticles [2] to [18]>

Surface-modified metal oxide microparticles [2] to [18] were produced in the same way as surface-modified metal oxide microparticles [1] except that the metal oxide microparticles, the hole-transporting compound, and the coupling agent having a polymerizable reactive group were those shown in Table 1.

<Production of Surface-Modified Metal Oxide Microparticles [19] and [20]>

Surface-modified metal oxide microparticles [19] and [20] were produced in the same way as surface-modified metal oxide microparticles [1] except that no hole-transporting compound was used and that the metal oxide microparticles and the coupling agent having a polymerizable reactive group were those shown in Table 1.

<Intermediate Layer>

A dispersion having the following composition was diluted with the solvent mixture shown below by 1.5-fold. After leaving to stand overnight, filtration (filter: Rigimesh 5 μm Filter, manufactured by Pall Corporation Japan) was carried out to prepare an intermediate layer coating solution.

Binder resin: 100 parts by mass of polyamide resin "CM8000", (manufactured by Toray Industries, Inc.), Metal oxide microparticles: 120 parts by mass of titanium oxide "SMT500SAS" (manufactured by Tayca Corporation), Metal oxide microparticles: 155 parts by mass of titanium oxide "SMT150MK" (manufactured by Tayca Corporation), and Solvent mixture: 1290 parts by mass of ethanol/n-propyl alcohol/tetrahydrofuran (volume ratio: 60/20/20).

These components were dispersed with a sand mill disperser by a batch process for 5 hr.

The coating solution was applied onto the support by immersion coating to form an intermediate layer having a dried thickness of 2 μm.

<Charge-Generating Layer>

Charge-generating material: 20 parts by mass of titanyl phthalocyanine pigment (titanyl phthalocyanine pigment having a maximum diffraction peak at least at 27.3° in Cu—Kα characteristic X-ray diffraction spectroscopy), Binder resin: 10 parts by mass of polyvinyl butyral resin "#6000-C" (manufactured by Denki Kagaku Kogyo Kabushiki Kaisha), and Solvent mixture: 700 parts by mass of t-butyl acetate and 300 parts by mass of 4-methoxy-4-methyl-2-pentanone.

TABLE 1

| Surface-modified metal oxide microparticle No. | Metal oxide microparticle: Type | Number-average primary particle diameter [nm] | Amount [parts by mass] | Surface modifier: Hole-transporting compound: Type | Amount [parts by mass] | Coupling agent having a polymerizable reactive group: Type | Amount [parts by mass] | $IP_B$ [eV] |
|---|---|---|---|---|---|---|---|---|
| [1] | $SnO_2$ | 20 | 100 | HTM-1 | 1.5 | S-15 | 7.0 | 5.76 |
| [2] | $SnO_2$ | 20 | 100 | HTM-1 | 3.0 | S-15 | 7.0 | 5.76 |
| [3] | $SnO_2$ | 20 | 100 | HTM-1 | 10.0 | S-15 | 7.0 | 5.77 |
| [4] | $SnO_2$ | 20 | 100 | HTM-1 | 4.0 | S-15 | 3.0 | 5.73 |
| [5] | $SnO_2$ | 20 | 100 | HTM-1 | 10.0 | S-15 | 3.0 | 5.74 |
| [6] | $SnO_2$ | 20 | 100 | HTM-2 | 1.5 | S-15 | 7.0 | 5.67 |
| [7] | $SnO_2$ | 20 | 100 | HTM-20 | 1.5 | S-15 | 7.0 | 5.65 |
| [8] | $SnO_2$ | 20 | 100 | HTM-17 | 1.5 | S-15 | 7.0 | 5.74 |
| [9] | $SnO_2$ | 20 | 100 | HTM-11 | 1.5 | S-15 | 7.0 | 5.68 |
| [10] | $SnO_2$ | 20 | 100 | HTM-38 | 1.5 | S-15 | 7.0 | 5.63 |
| [11] | $SnO_2$ | 20 | 100 | HTM-40 | 1.5 | S-15 | 7.0 | 5.80 |
| [12] | $SnO_2$ | 20 | 100 | HTM-42 | 1.5 | S-15 | 7.0 | 5.76 |
| [13] | $SnO_2$ | 20 | 100 | HTM-2 | 4.0 | S-15 | 3.0 | 5.63 |
| [14] | $SnO_2$ | 20 | 100 | HTM-20 | 4.0 | S-15 | 3.0 | 5.68 |
| [15] | $TiO_2$ | 10 | 100 | HTM-1 | 1.5 | S-15 | 7.0 | 5.53 |
| [16] | $Al_2O_3$ | 30 | 100 | HTM-1 | 1.5 | S-15 | 7.0 | 5.66 |
| [17] | $SiO_2$ | 50 | 100 | HTM-1 | 1.5 | S-15 | 7.0 | 5.78 |
| [18] | $CuAlO_2$ | 15 | 100 | HTM-20 | 1.5 | S-15 | 7.0 | 5.26 |
| [19] | $SnO_2$ | 20 | 100 | — | 0.0 | S-15 | 7.0 | 5.94 |
| [20] | $CuAlO_2$ | 15 | 100 | — | 0.0 | S-15 | 7.0 | 5.18 |

<Production of Photoreceptor 1>

Photoreceptor 1 was produced as follows.

An electroconductive support was prepared by machining the surface of a cylindrical aluminum support having a diameter of 60 mm.

These components were mixed and dispersed with a sand mill for 10 hr to prepare a charge-generating layer coating solution. This coating solution was applied onto the intermediate layer by immersion coating to form a charge-generating layer having a dried thickness of 0.3 μm.

<Charge-Transporting Layer>

Charge-transporting material: 225 parts by mass of 4,4'-dimethyl-4"-(β-phenylstyryl)triphenylamine, Binder: 300 parts by mass of polycarbonate "Z300" (manufactured by Mitsubishi Gas Chemical Company, Inc.), Antioxidant: 6 parts by mass of "Irganox (registered trademark) 1010" (manufactured by BASF Japan Ltd.), Solvent mixture: 1600 parts by mass of tetrahydrofuran and 400 parts by mass of toluene, and Additive: 1 part by mass of silicone oil "KF-54" (manufactured by Shin-Etsu Chemical Co., Ltd.).

These components were mixed and dissolved to prepare a charge-transporting layer coating solution. This coating solution was applied onto the charge-generating layer by immersion coating to form a charge-transporting layer having a dried thickness of 20 μm.

<Surface Protective Layer>

Surface-modified metal oxide microparticle [1]: 120 parts by mass,

Polymerizable compound: 100 parts by mass of Example compound "Mc-1",

Polymerization initiator: 6 parts by mass of "Irgacure (registered trademark) 819" (manufactured by BASF Japan Ltd.), and Solvent mixture: 466 parts by mass of 2-butanol and 57 parts by mass of tetrahydrofuran.

These were mixed and stirred for sufficient dissolution and dispersion to prepare a surface protective layer coating solution. The coating solution was applied onto the charge-transporting layer of the photoreceptor with a circular slide hopper applicator. The applied surface protective layer coating solution was irradiated with ultraviolet rays using a xenon lamp for 1 min, and the coating film was dried at 80° C. for 70 min to form a surface protective layer having a dried thickness of 3.0 μm. "Photoreceptor 1" was thereby produced.

<Production of Photoreceptors 2 to 30>

"Photoreceptors 2 to 30" of the present invention were produced in the same way as photoreceptor 1 except that the surface-modified metal oxide microparticles and the charge-transporting material (CTM) contained in the charge-transporting layer were those shown in Table 2. After the application of each surface protective layer coating solution, irradiation with ultraviolet rays for 1 min and drying at 80° C. for 70 min were performed as in above to form a surface protective layer having a dried thickness of 3.0 μm.

<Production of Photoreceptors 31 to 34>

"Photoreceptors 31 to 34" of Comparative Examples were produced in the same way as photoreceptor 1 except that the surface-modified metal oxide microparticles and the charge-transporting material (CTM) contained in the charge-transporting layer were those shown in Table 2.

TABLE 2

| Photo-receptor No. | Surface-modified metal oxide microparticle: No. | Amount [parts by mass] | $IP_B$ [eV] | Charge-transporting material in charge-transporting layer: Example compound | $IP_A$ [eV] | Difference in IP ($IP_A - IP_B$) [eV] |
|---|---|---|---|---|---|---|
| 1 | [1] | 120 | 5.76 | CTM-1 | 5.42 | −0.34 |
| 2 | [1] | 200 | 5.76 | CTM-1 | 5.42 | −0.34 |
| 3 | [1] | 240 | 5.76 | CTM-1 | 5.42 | −0.34 |
| 4 | [1] | 120 | 5.76 | CTM-2 | 5.62 | −0.14 |
| 5 | [1] | 120 | 5.76 | CTM-3 | 5.48 | −0.28 |
| 6 | [1] | 120 | 5.76 | CTM-4 | 5.62 | −0.14 |

TABLE 2-continued

| Photo-receptor No. | Surface-modified metal oxide microparticle: No. | Amount [parts by mass] | $IP_B$ [eV] | Charge-transporting material in charge-transporting layer: Example compound | $IP_A$ [eV] | Difference in IP ($IP_A - IP_B$) [eV] |
|---|---|---|---|---|---|---|
| 7 | [2] | 120 | 5.76 | CTM-1 | 5.42 | −0.34 |
| 8 | [3] | 120 | 5.77 | CTM-1 | 5.42 | −0.35 |
| 9 | [4] | 120 | 5.73 | CTM-1 | 5.42 | −0.31 |
| 10 | [4] | 200 | 5.73 | CTM-1 | 5.42 | −0.31 |
| 11 | [4] | 240 | 5.73 | CTM-1 | 5.42 | −0.31 |
| 12 | [5] | 120 | 5.74 | CTM-1 | 5.42 | −0.32 |
| 13 | [6] | 120 | 5.67 | CTM-1 | 5.42 | −0.25 |
| 14 | [7] | 120 | 5.65 | CTM-1 | 5.42 | −0.23 |
| 15 | [7] | 120 | 5.65 | CTM-2 | 5.62 | −0.03 |
| 16 | [7] | 120 | 5.65 | CTM-3 | 5.48 | −0.17 |
| 17 | [7] | 120 | 5.65 | CTM-4 | 5.62 | −0.03 |
| 18 | [8] | 120 | 5.74 | CTM-1 | 5.42 | −0.32 |
| 19 | [9] | 120 | 5.68 | CTM-1 | 5.42 | −0.26 |
| 20 | [10] | 120 | 5.63 | CTM-1 | 5.42 | −0.21 |
| 21 | [11] | 120 | 5.80 | CTM-1 | 5.42 | −0.38 |
| 22 | [12] | 120 | 5.76 | CTM-1 | 5.42 | −0.34 |
| 23 | [13] | 120 | 5.63 | CTM-1 | 5.42 | −0.21 |
| 24 | [14] | 120 | 5.68 | CTM-1 | 5.42 | −0.26 |
| 25 | [15] | 120 | 5.53 | CTM-1 | 5.42 | −0.11 |
| 26 | [16] | 120 | 5.66 | CTM-1 | 5.42 | −0.24 |
| 27 | [17] | 120 | 5.78 | CTM-1 | 5.42 | −0.36 |
| 28 | [18] | 120 | 5.26 | CTM-1 | 5.42 | 0.16 |
| 29 | [18] | 120 | 5.26 | CTM-11 | 5.65 | 0.39 |
| 30 | [18] | 120 | 5.26 | CTM-5 | 5.50 | 0.24 |
| 31 | [19] | 120 | 5.94 | CTM-1 | 5.42 | −0.52 |
| 32 | [20] | 120 | 5.18 | CTM-2 | 5.62 | 0.44 |
| 33 | [1] | 120 | 5.76 | CTM-9 | 5.30 | −0.46 |
| 34 | [1] | 120 | 5.76 | CTM-16 | 5.31 | −0.45 |

<<Evaluation of Photoreceptor>>

Photoreceptors 1 to 34 prepared above were evaluated as follows.

Each photoreceptor was mounted on a digital full color multi-function printer "bizhub PRO C6501" manufactured by Konica Minolta, Inc., which had basically the same structure as that shown in FIG. 2, and was evaluated.

Photoreceptors 1 to 34 were each evaluated for durability by continuous print of a character image having an image area ratio of 6% on both sides of 300000 sheets of size A4 paper (600000 prints in total) by transverse feed in a normal-temperature and normal-humidity environment (23° C. and 50% RH). The abrasion resistance, image memory, and image blurring of each photoreceptor were evaluated in accordance with the following indications.

[Evaluation of Abrasion Resistance]

The thickness of the photosensitive layer was measured before and after the durability test, and the abrasive reduction in the thickness was calculated for evaluation of the abrasion resistance.

The thickness of a photosensitive layer was measured at randomly selected 10 points in a uniform thickness portion (excluding variable thickness portions at the front and rear ends of application based on a thickness profile), and the average value of the measured thicknesses was defined as the thickness of the photosensitive layer.

The thickness was measured with an eddy-current thickness meter "EDDY560C" (manufactured by Fischer Instruments K.K.). The difference in thickness of the photosensitive layer between before and after the durability test was defined as an abrasive reduction in the thickness. The abrasive reduction (μm) per 100 krot (100000 revolutions) was shown as an α value in Table 3. An a value of 0.30 (μm/100 krot) or less indicates that the wear resistance is acceptable.

[Evaluation of Image Memory]

After the durability test, an image including solid black and solid white portions was continuously printed on 10 sheets of paper. Subsequently, a uniform half tone image was printed, and the history of the solid black and the solid white portions (occurrence of image memory) was observed.

◎ (excellent): no image memory

○ (practical): slightly visible image memory

Δ (impractical): visible image memory x (impractical): distinct image memory

[Evaluation of Image Blurring]

After the durability test, another durability test was performed by continuous print (a character image having an image area ratio of 6% on A4 paper sheets, transverse feed) on one side of 500000 sheets of paper in a high-temperature and high-humidity environment (30° C. and 80% RH). Immediately after this durability test, the main power of the actual machine was switched off. The power was switched on 12 hr after the switching-off, and a half-tone image (relative reflection density: 0.4, measured with a Macbeth densitometer) and a 6-dot lattice image were printed on the entire surface of size A3 acid-free paper immediately after that the machine changed into ready to print. The printed images were investigated for the following evaluation.

◎ (excellent): no image blurring in both the half tone and lattice images

○ (practical): a slight reduction in density in a strip form along the longitudinal direction of the photoreceptor only in the half tone image Δ (impractical): partial defects or thinning of line width of the lattice image due to image blurring x (impractical): defects or thinning of line width over the whole lattice image due to image blurring The results of evaluation are shown in Table 3.

TABLE 3

| | Evaluation | | | |
|---|---|---|---|---|
| Photo-receptor No. | Abrasion resistance α value [μm/100 krot] | Image memory | Image blurring | Notes |
| 1 | 0.15 | ○ | ◎ | Invention |
| 2 | 0.10 | ○ | ○ | Invention |
| 3 | 0.05 | ○ | ○ | Invention |
| 4 | 0.16 | ◎ | ◎ | Invention |
| 5 | 0.15 | ◎ | ◎ | Invention |
| 6 | 0.15 | ◎ | ◎ | Invention |
| 7 | 0.14 | ○ | ○ | Invention |
| 8 | 0.16 | ○ | ○ | Invention |
| 9 | 0.24 | ○ | ○ | Invention |
| 10 | 0.19 | ○ | ○ | Invention |
| 11 | 0.12 | ○ | ○ | Invention |
| 12 | 0.25 | ○ | ○ | Invention |
| 13 | 0.17 | ◎ | ◎ | Invention |
| 14 | 0.16 | ◎ | ◎ | Invention |
| 15 | 0.18 | ◎ | ◎ | Invention |
| 16 | 0.17 | ◎ | ◎ | Invention |
| 17 | 0.17 | ◎ | ◎ | Invention |
| 18 | 0.16 | ○ | ◎ | Invention |
| 19 | 0.19 | ◎ | ○ | Invention |
| 20 | 0.16 | ◎ | ○ | Invention |
| 21 | 0.19 | ○ | ○ | Invention |
| 22 | 0.15 | ○ | ○ | Invention |
| 23 | 0.25 | ◎ | ○ | Invention |
| 24 | 0.23 | ◎ | ○ | Invention |
| 25 | 0.12 | ◎ | ○ | Invention |
| 26 | 0.10 | ◎ | ○ | Invention |
| 27 | 0.14 | ○ | ○ | Invention |
| 28 | 0.15 | ◎ | ○ | Invention |
| 29 | 0.14 | ○ | ○ | Invention |

TABLE 3-continued

| | Evaluation | | | |
|---|---|---|---|---|
| Photo-receptor No. | Abrasion resistance α value [μm/100 krot] | Image memory | Image blurring | Notes |
| 30 | 0.15 | ◎ | ○ | Invention |
| 31 | 0.14 | X | ○ | Comparative Example |
| 32 | 0.16 | Δ | X | Comparative Example |
| 33 | 0.15 | X | ○ | Comparative Example |
| 34 | 0.14 | X | ○ | Comparative Example |

The results demonstrate that photoreceptors 1 to 30 of the present invention are excellent or practical in all the evaluation items and that photoreceptors 31 to 34 of comparative examples are inferior to those of the present invention in at least one of the evaluation items. In photoreceptors 31, 33, and 34 of comparative examples, the ionization potential ($IP_B$) of the metal oxide microparticles in the surface protective layer is higher than the ionization potential ($IP_A$) of the change-transporting material contained in the charge-transporting layer; hence, the charge injection barrier from the charge-transporting layer to the surface protective layer is high and prevents injection of charge, resulting in an insufficient reduction in image memory. In photoreceptor 32 of comparative example, the ionization potential ($IP_B$) of the metal oxide microparticles in the surface protective layer is low; hence, oxidation readily occurs, and the effect of preventing image blurring was low.

The entire disclosure of Japanese Patent Application No. 2014-117457 filed on Jun. 6, 2014 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An electrophotographic photoreceptor comprising:

a charge-generating layer;

a charge-transporting layer; and a surface protective layer sequentially deposited on an electroconductive support, wherein the charge-transporting layer contains a charge-transporting material having an ionization potential ($IP_A$), the surface protective layer contains a binder resin, and a metal oxide microparticle having an ionization potential ($IP_B$), the ionization potential ($IP_A$) and the ionization potential ($IP_B$) satisfy a relationship represented by Expression (A):

$$-0.4\ \text{eV} \leq (IP_A - IP_B) \leq 0.4\ \text{eV}, \text{ and}$$

the metal oxide microparticle has a surface modified with a hole-transporting compound having a structure represented by Formula (1):

$$A\text{-}(\text{-}R_1\text{-}Q_1)_k \qquad \text{Formula(1)}$$

wherein A represents a hole transportable group; $Q_1$ represents an acidic group; $R_1$ represents a substituted or unsubstituted alkylene, alkenylene, alkynylene, or arylene group; and k represents a positive integer of 1 or more, provided that when k represents an integer of 2 or more, $R_1$s may be the same or different, and $Q_1$s may be the same or different.

2. The electrophotographic photoreceptor according to claim 1, wherein the hole-transporting compound having the structure represented by Formula (1) is a compound having a structure represented by Formula (2):

[Chem. 2]

Formula (2)

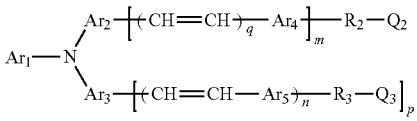

wherein $Ar_1$ represents a substituted or unsubstituted aryl group; $Ar_2$, $Ar_3$, $Ar_4$, and $Ar_5$ each independently represent a substituted or unsubstituted arylene group; $R_2$ and $R_3$ each independently represent a substituted or unsubstituted alkylene, alkenylene, alkynylene, or arylene group; $Q_2$ and $Q_3$ each independently represent an acidic group; m, n, p, and q each independently represent 0 or 1, provided that when p represents 0, $Ar_3$ represents a substituted or unsubstituted aryl group.

3. The electrophotographic photoreceptor according to claim 2, wherein the acidic group represented by $Q_2$ or $Q_3$ in Formula (2) is a carboxy, phosphonate, phosphinate, or sulfonate group.

4. The electrophotographic photoreceptor according to claim 1, wherein the binder resin contained in the surface protective layer is prepared by polymerization of a crosslinkable polymerizable compound.

5. The electrophotographic photoreceptor according to claim 4, wherein the crosslinkable polymerizable compound has an acryloyl group or a methacryloyl group.

6. The electrophotographic photoreceptor according to claim 1, wherein the metal oxide microparticle has the surface modified with the hole-transporting compound represented by Formula (1) and a coupling agent having a polymerizable reactive group.

7. The electrophotographic photoreceptor according to claim 6, wherein the coupling agent having the polymerizable reactive group is a silane coupling agent having the polymerizable reactive group.

8. The electrophotographic photoreceptor according to claim 1, wherein the metal oxide microparticle is a $SnO_2$ microparticle, a $TiO_2$ microparticle, an $Al_2O_3$ microparticle, or a $CuAlO_2$ microparticle.

* * * * *